US009330617B2

(12) United States Patent
Shin et al.

(10) Patent No.: US 9,330,617 B2
(45) Date of Patent: May 3, 2016

(54) METHOD OF DRIVING A DISPLAY PANEL AND DISPLAY APPARATUS FOR PERFORMING THE SAME

(71) Applicant: Samsung Display Co., LTD., Yongin, Gyeonggi-Do (KR)

(72) Inventors: Yong-Hwan Shin, Yongin-si (KR); Baek-Kyun Jeon, Yongin-si (KR)

(73) Assignee: Samsung Display Co., Ltd. (KR)

( * ) Notice: Subject to any disclaimer, the term of this patent is extended or adjusted under 35 U.S.C. 154(b) by 207 days.

(21) Appl. No.: 13/791,399

(22) Filed: Mar. 8, 2013

(65) Prior Publication Data

US 2013/0235006 A1 Sep. 12, 2013

(30) Foreign Application Priority Data

Mar. 12, 2012 (KR) ..... 10-2012-0025188

(51) Int. Cl.
*G09G 3/36* (2006.01)
*G09G 3/00* (2006.01)

(52) U.S. Cl.
CPC ..... *G09G 3/3611* (2013.01); *G09G 3/003* (2013.01); *G09G 3/3648* (2013.01); *G09G 2310/0202* (2013.01)

(58) Field of Classification Search
CPC ... G09G 3/003; G09G 3/3977; G09G 3/3648; G09G 3/36; G09G 3/3611; G09G 3/3659; G09G 2310/0202; H04N 13/0422; H04N 13/0452; H04N 2013/0463; H04N 13/0465; H04N 13/0445; H04N 13/0044
USPC ..... 345/694, 211, 100, 419
See application file for complete search history.

(56) References Cited

U.S. PATENT DOCUMENTS

| | | | | |
|---|---|---|---|---|
| 8,564,627 | B2 * | 10/2013 | Suzuki | G09G 3/003 345/100 |
| 2007/0195055 | A1 * | 8/2007 | Kim | G09G 3/3677 345/100 |
| 2010/0026795 | A1 | 2/2010 | Moller et al. | |
| 2010/0265230 | A1 * | 10/2010 | Kang | G09G 3/003 345/211 |
| 2012/0032949 | A1 * | 2/2012 | Lim | H04N 13/0434 345/419 |
| 2012/0098822 | A1 * | 4/2012 | Kim | H04N 13/0438 345/419 |
| 2013/0002653 | A1 * | 1/2013 | Lee | H04N 13/0438 345/419 |

FOREIGN PATENT DOCUMENTS

| | | |
|---|---|---|
| JP | 2010-250257 | 11/2010 |
| KR | 10-2008-0032354 | 4/2008 |
| KR | 10-2011-0053044 | 5/2011 |
| KR | 10-2011-0060272 | 6/2011 |
| KR | 10-2011-0109405 | 10/2011 |

* cited by examiner

*Primary Examiner* — Aneeta Yodichkas
*Assistant Examiner* — Chineyere Wills-Burns
(74) *Attorney, Agent, or Firm* — Innovation Counsel LLP

(57) ABSTRACT

There is provided a method of driving a display panel. In the method, it is determined whether a driving mode is a two-dimensional image mode or a three-dimensional image mode. A first gate driving control signal and a second gate driving control signal are generated by converting an input control signal inputted in accordance with the driving mode. A first gate signal is outputted to an odd-numbered gate line connected to a first sub-pixel within a unit pixel of the display panel based on the first gate driving control signal. A second gate signal is outputted to an even-numbered gate line connected to a second sub-pixel within the unit pixel of the display panel based on the second gate driving control signal.

32 Claims, 10 Drawing Sheets

| GRAY | GRAYH | GRAYL |
|---|---|---|
| 1 | GRAYH1 | GRAYL1 |
| 2 | GRAYH2 | GRAYL2 |
| 3 | GRAYH3 | GRAYL3 |
| ⋮ | ⋮ | ⋮ |

METHOD OF DRIVING A DISPLAY PANEL AND DISPLAY APPARATUS FOR PERFORMING THE SAME

CROSS-REFERENCE TO RELATED APPLICATIONS

This application claims priority under 35 U.S.C. §119 to Korean Patent Application No. 10-2012-0025188, filed on Mar. 12, 2012 in the Korean Intellectual Property Office (KIPO), the contents of which are herein incorporated by reference in their entirety.

BACKGROUND OF THE INVENTION

1. Technical Field

Exemplary embodiments of the present invention relate to a method of driving a display panel and a display apparatus for performing the method. More particularly, exemplary embodiments of the present invention relate to a method of driving a display panel for enhancing a display quality when the display panel displays a two-dimensional image (hereinafter, referred to as a 2D image) and a three-dimensional image (hereinafter, referred to as a 3D image) and a display apparatus for performing the method.

2. Discussion of the Related Art

Generally, a display apparatus displays 2D images. Recently, according to increasing demands for 3D images in fields of games, movies and so on, display apparatuses for displaying the 3D images have been developed continuously. An observer watches the 2D images different from each other through a left eye and a right eye, respectively, and the observer's brain mixes the 2D images, so that the 3D images may be perceived.

A 3D image display apparatus displays 3D images by using a binocular parallax of the observer. For example, since two eyes of the observer are spaced apart from each other, images viewed at different angles, for example an image viewed through left eye and an image viewed through a right eye, are inputted to the observer's brain. A left eye image and a right eye image are then combined in the brain to give the perception of 3D depth.

The 3D image display apparatus using the binocular parallax may be fall into a stereoscopic type display apparatus and an autostereoscopic type display apparatus according as whether specific glasses are necessary or not. The stereoscopic type display apparatus may be divided into an anaglyph type display apparatus, a shutter glasses type display apparatus, etc. In the anaglyph type display apparatus, a pair of glasses having a blue lens and a red lens is used by a user. In the shutter glasses type display apparatus, a left-eye image and a right-eye image are displayed on the display apparatus during a period, and a left-eye shutter and a right-eye shutter are opened and closed in synchronization with the images displayed.

In the shutter glasses type display apparatus capable of selectively displaying a 2D image and a 3D image, a technology in which a unit pixel of the display panel is divided into a high pixel and a low pixel has been developed in order to enhance a viewing angle in the 2D image mode.

However, when a unit pixel of the display panel is divided into a high pixel and a low pixel, a left-eye image and a right-eye image are alternatingly displayed so that the 3D image mode requires a fast driving time rather than a 2D image mode.

SUMMARY OF THE INVENTION

Exemplary embodiments of the present invention provide a method of driving a display panel capable of enhancing a display quality when the display panel displays a 2D image and a 3D image.

Exemplary embodiments of the present invention also provide a display apparatus for performing the above-mentioned method.

According to one aspect of the present invention, there is provided a method of driving a display panel. In the method, it is determined whether a driving mode is a two-dimensional image mode or a three-dimensional image mode. A first gate driving control signal and a second gate driving control signal are generated by converting an input control signal inputted in accordance with the driving mode. A first gate signal is outputted to an odd-numbered gate line connected to a first sub-pixel within a unit pixel of the display panel based on the first gate driving control signal. A second gate signal is outputted to an even-numbered gate line connected to a second sub-pixel within the unit pixel of the display panel based on the second gate driving control signal. The odd-numbered gate line and the even numbered gate line adjacent to the odd-numbered gate line have a different activation time in a two-dimensional image mode and the odd-numbered gate line and the even numbered gate line adjacent to the odd-numbered gate line have a same activation time in a three-dimensional image mode.

In an exemplary embodiment of the present invention, the first sub-pixel is a high pixel and the second sub-pixel is a low pixel having a lower pixel voltage than the high pixel.

In an exemplary embodiment of the present invention, a first odd-numbered gate line and a first even numbered gate line adjacent to the first odd-numbered gate line have a first activation time, and a second odd-numbered gate line adjacent to the first even-numbered gate line and a second even numbered gate line adjacent to the second odd-numbered gate line have a second activation time having one interval delay in the three-dimensional image mode.

In an exemplary embodiment of the present invention, further comprises supplying the first gate driving control signal and the second driving control signal to a first gate driving part and a second gate driving part, respectively.

According to one aspect of the present invention, there is provided a method of driving a display panel. In the method, it is determined whether a driving mode is a two-dimensional image mode or a three-dimensional image mode. A first gate driving control signal and a second gate driving control signal are generated by converting an input control signal inputted in accordance with the driving mode. A first gate signal is outputted to an odd-numbered gate line connected to a first sub-pixel and a second sub-pixel based on the first gate driving control signal. A second gate signal is outputted to an even-numbered gate line connected to a first sub-pixel and a second sub-pixel based on the second gate driving control signal. The odd-numbered gate line and the even numbered gate line adjacent to the odd-numbered gate line have a different activation time in a two-dimensional image mode and the odd-numbered gate line and the even numbered gate line adjacent to the odd-numbered gate line have a same activation time in a three-dimensional image mode.

According to another aspect of the present invention, a display apparatus includes a display panel, a timing controller, a gate driving part and a second gate driving part. The display panel includes a plurality of unit pixels comprising a first sub-pixel and a second sub-pixel. The timing controller determines whether a driving mode is a two-dimensional image mode or a three-dimensional image mode, and generating a first gate driving control signal and a second gate driving control signal by converting an input control signal inputted in accordance with the driving mode. The first gate driving part outputs a first gate signal to an odd-numbered gate line. The second gate driving part outputs a second gate signal to an even-numbered gate line. The first gate signal and the second gate signal have a different activation time in a two-dimensional image mode and the first gate signal and the second gate signal adjacent to the first gate signal have a same activation time in a three-dimensional image mode.

In an exemplary embodiment of the present invention, an n-th even gate line may be disposed between an n-th odd gate line and an (n+1)-th odd gate line ('n' is a natural number), and the first gate signal or the second gate signal may be sequentially outputted to the n-th odd gate line, the n-th even gate line and the (n+1)-th odd gate line in the two-dimensional image mode.

In an exemplary embodiment of the present invention, a first voltage may be charged in the first sub-pixel, and a second voltage lower than the first voltage may be charged in the second sub-pixel.

In an exemplary embodiment of the present invention, an n-th odd gate line may be disposed between an n-th odd gate line and an (n+1)-th even gate line ('n' is a natural number), and the first gate signal or the second gate signal may be simultaneously outputted to the n-th even gate line and the n-th odd gate line in the three-dimensional image mode.

In an exemplary embodiment of the present invention, a third voltage may be charged in the first and the second sub-pixels.

In an exemplary embodiment of the present invention, each of the first sub-pixel and the second sub-pixel in the unit pixels in a same column may be connected to different gate lines and a same data line.

In an exemplary embodiment of the present invention, the first sub-pixel may include a first switching element, a first liquid crystal capacitor connected to the first switching element and a first storage capacitor connected to the first switching element. The second sub-pixel may include a second switching element, a second liquid crystal capacitor connected to the second switching element and a first storage capacitor connected to the second switching element. In this case, the first switching element may be connected to an odd-numbered gate line, and the second switching element may be connected to an even-numbered gate line.

In an exemplary embodiment of the present invention, each of the first sub-pixel and the second sub-pixel in the unit pixels in a same row may be connected to a same gate line and the different data lines.

In an exemplary embodiment of the present invention, each of the unit pixels may include a first unit pixel, a second unit pixel, a third unit pixel and a fourth unit pixel. The first unit pixel may be connected to a first gate line, a first data line and a second data line adjacent to the first data line. The second unit pixel may be connected to a second gate line adjacent to the first gate line, a third data line adjacent to the second data line and a fourth data line adjacent to the third data line. The third unit pixel may be connected to the first gate line, the third data line and the fourth data line. The fourth unit pixel may be connected to the second gate line, the first data line and the second data line. A switching element of the first sub-pixel of the first unit pixel may be connected to the first gate line and the first data line, and a switching element of the first sub-pixel of the third unit pixel may be connected to the first gate line and the fourth data line. A switching element of the second sub-pixel of the first unit pixel may be connected to the first gate line and the second data line, and a switching element of the second sub-pixel of the third unit pixel may be connected to the second gate line and the fourth data line.

In an exemplary embodiment of the present invention, a switching element of the first sub-pixel of the second unit pixel may be connected to the second gate line and the third data line, and a switching element of the first sub-pixel of the fourth unit pixel may be connected to the second gate line and the second data line. A switching element of the second sub-pixel of the second unit pixel may be connected to the second gate line and the fourth data line, and a switching element of the second sub-pixel of the fourth unit pixel may be connected to the second gate line and the first data line.

In an exemplary embodiment of the present invention, each of the unit pixels may include a first unit pixel, a second unit pixel, a third unit pixel and a fourth unit pixel. The first unit pixel may be connected to a first gate line, a first data line and a second data line adjacent to the first data line. The second unit pixel may be connected to a second gate line adjacent to the first gate line, a third data line adjacent to the second data line and a fourth data line adjacent to the third data line. The third unit pixel may be connected to the first gate line, the third data line and the fourth data line. The fourth unit pixel may be connected to the second gate line, the first data line and the second data line. The switching element of the first sub-pixel of the first unit pixel may be connected to the first gate line and the first data line, and a switching element of the first sub-pixel of the third unit pixel may be connected to the first gate line and the third data line. A switching element of the second sub-pixel of the first unit pixel may be connected to the first gate line and the second data line, and a switching element of the second sub-pixel of the third unit pixel may be connected to the first gate line and the fourth data line.

In an exemplary embodiment of the present invention, a switching element of the first sub-pixel of the second unit pixel may be connected to the second gate line and the third data line, and a switching element of the first sub-pixel of the fourth unit pixel may be connected to the second gate line and the first data line. A switching element of the second sub-pixel of the second unit pixel may be connected to the second gate line and the fourth data line, and a switching element of the second sub-pixel of the fourth unit pixel may be connected to the second gate line and the second data line.

According to a method of driving a display panel and a display apparatus for performing the method, a unit pixel is divided into a high pixel and a low pixel to be driven when a 2D image is displayed thereon, thereby enhancing a side visibility. Moreover, the high pixel and the low pixel are driven in the same timing to decrease a scanning time of a gate line when a 3D image is displayed thereon, thereby enhancing a display characteristics of the 3D image. Thus, a display quality may be enhanced when the display panel displays the 2D image and the 3D image.

BRIEF DESCRIPTION OF THE DRAWINGS

The above and other features and aspects of the present invention will become more apparent by describing in detailed exemplary embodiments thereof with reference to the accompanying drawings, in which.

DETAILED DESCRIPTION OF THE INVENTION

Hereinafter, embodiments of the present invention will be explained in detail with reference to the accompanying drawings.

Figure 1:
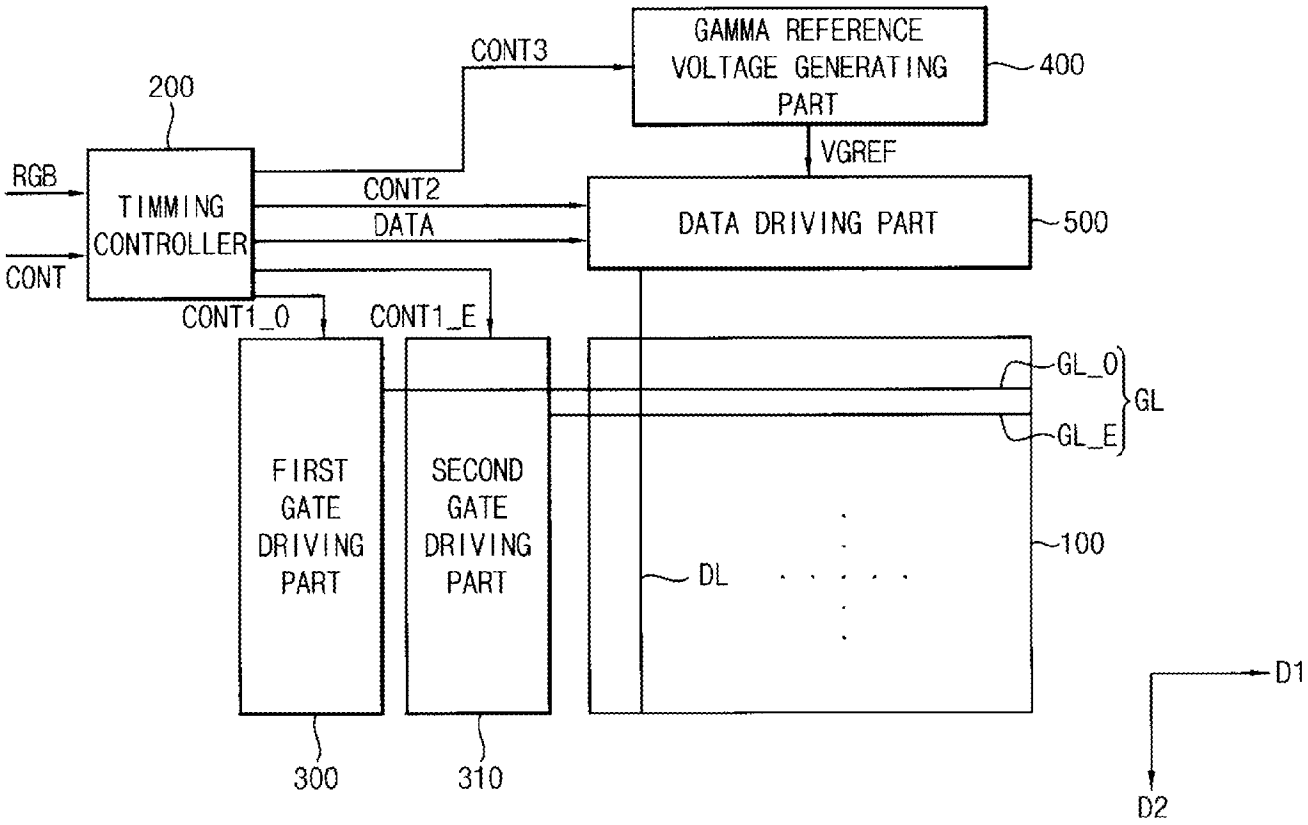
FIG. 1 is a block diagram illustrating a display apparatus according to an exemplary embodiment of the present invention.

FIG. 1 is a block diagram illustrating a display apparatus according to an exemplary embodiment of the present invention.

Referring to FIG. 1, a display apparatus includes a display panel 100 and a panel driving part. The panel driving part includes a timing controller 200, a first gate driving part 300, a second gate driving part 310, a gamma reference voltage generating part 400 and a data driving part 500.

The display panel 100 includes a plurality of gate lines GL, a plurality of data lines DL and a plurality of unit pixels electrically connected to the gate line and the data line, respectively. The gate lines GL extend in a first direction D1, and the data lines DL extend in a second direction D2 crossing the first direction D1.

Each of the unit pixel may include a switching element (not shown), a liquid crystal capacitor (not shown) electrically connected to the switching element and a storage capacitor (not shown) electrically connected to the switching element. The unit pixels may be disposed in a matrix shape.

Each of the unit pixels includes a first sub-pixel and a second sub-pixel. A configuration of the unit pixel will be explained with reference to FIG. 2.

The timing controller 200 receives input image data RGB and an input control signal CONT from an external device (not shown). The input image data may include a red image data R, a green image data G and a blue image data B. The input control signal CONT includes a driving mode signal including a 2D image mode and a 3D image mode. The input control signal CONT may further include a master clock signal and a data enable signal. The input control signal CONT may further include a vertical start signal and a horizontal start signal.

The timing controller 200 generates a first gate driving control signal CONT1_O, a second gate driving control signal CONT1_E, a second control signal CONT2, a third control signal CONT3 and a data signal DATA based in the input image data RGB and the input control signal CONT.

The timing controller 200 generates the first gate driving control signal CONT1_O for controlling an operation of the first gate driving part 300 based on the input control signal CONT to output first gate driving control signal CONT1_O to the first gate driving part 300. The first gate driving control signal CONT1_O may include the driving mode signal. The first gate driving control signal CONT1_O may include a first vertical start signal STV_O and a gate clock signal.

The timing controller 200 generates the second gate driving control signal CONT1_E for controlling an operation of the second gate driving part 310 based on the input control signal CONT to output second gate driving control signal CONT1_E to the second gate driving part 310. The second gate driving control signal CONT1_E may include the driving mode signal. The second gate driving control signal CONT1_E may include a second vertical start signal STV_E and a gate clock signal.

The timing controller 200 generates the second control signal CONT2 for controlling an operation of the data driving part 500 based on the input control signal CONT to output second control signal CONT2 to the data driving part 500. The second control signal CONT2 may include the driving mode signal. The second control signal CONT2 may include a horizontal start signal and a load signal.

The timing controller 200 generates a data signal DATA by rendering the input image data RGB based on the driving mode to generate a data signal DATA. The timing controller 200 output the data signal DATA to the data driving part 500.

In the 2D image mode, the data signal DATA may include a 2D data signal. In the 3D image mode, the data signal DATA may include a left-eye data signal and a right-eye data. In the 3D image mode, the data signal DATA may further include a black data signal inserted between the left-eye data signal and the right-eye data signal.

The timing controller 200 generates the third control signal CONT3 for controlling an operation of the gamma reference voltage generating part 400 based on the input control signal CONT to output the third control signal CONT3 to the gamma reference voltage generating part 400. The third control signal CONT3 may include a driving mode signal.

The timing controller 200 may further include a control signal generating part (not shown) converting a frequency of the input control signal CONT inputted from an external device or shifts a phase of the input control signal CONT.

The first gate driving part 300 generates first gate signals for driving odd-numbered gate lines GL_O in response to the first gate driving control signal CONT1_O inputted from the timing controller 200. The first gate driving part 300 sequentially outputs the first gate signals to the odd-numbered gate lines GL_O. For example, the first gate driving part 300 may generate the first gate signals outputted to the odd gate lines GL_O in accordance with a first odd clock signal CK_O of the first gate driving control signal CONT1_O, a second odd clock signal CKB_O having a timing different from the first odd clock signal CK_O and a first vertical start signal STV_O. For example, the second odd clock signal CKB_O may be an inverted signal of the first odd clock signal CK_O. A detailed driving method of the first gate driving part 300 according to a driving mode will be described later.

The first gate driving part 300 may be directly mounted on the display panel 100 or connected to the display panel 100 using a tape carrier package ("TCP"). Alternatively, the first gate driving part 300 may be integrated on the display panel 100.

The second gate driving part 310 generates second gate signals for driving even-numbered gate lines GL_E in response to the second gate driving control signal CONT1_E inputted from the timing controller 200. The second gate driving part 310 sequentially outputs the second gate signals to the even-numbered gate lines GL_E. For example, the second gate driving part 310 may generate the second gate signals outputted to the even-numbered gate lines GL_E in accordance with a first even clock signal CK_E of the second gate driving control signal CONT1_E, a second even clock signal CKB_E having a timing different from the first even clock signal CK_E and a second vertical start signal STV_E. For example, the second even clock signal CKB_E may be an inverted signal of the first even clock signal CK_E. A detailed driving method of the second gate driving part 310 according to a driving mode will be described later.

The second gate driving part 310 may be directly mounted on the display panel 100 or connected to the display panel 100 using a TCP. Alternatively, the second gate driving part 310 may be integrated on the display panel 100.

Thus, the first gate driving part 300 and the second gate driving part 310 may be independently driven.

The gamma reference voltage generating part 400 generates a gamma reference voltage VGREF in response to the third control signal CONT3 inputted from the timing controller 200. The gamma reference voltage generating part 400 provides the gamma reference voltage VGREF to the data driving part 500. The gamma reference voltage VGREF has values corresponding to each of the data signal DATA.

The gamma reference voltage generating part 400 generates a gamma reference voltage VGREF different from each other with respect to same gradation data in accordance with the driving mode.

The gamma reference voltage generating part 400 may be disposed within the timing controller 200 or the data driving part 500.

The data driving part 500 receives the second control signal CONT2 and the data signal DATA from the timing controller 200 and receives the gamma reference voltage VGREF from the gamma reference voltage generating part 400. The data driving part 500 converts the data signal DATA into a data voltage of an analog type by using the gamma reference voltage VGREF. The data driving part 500 outputs the data voltage to the data line DL.

The data driving part 500 may include a shift register (not shown), a latch (not shown), a signal processing part (not shown) and a buffer part (not shown). The shift register outputs a latch pulse to the latch. The latch temporarily stores the data signal DATA and then output the data signal DATA to the signal processing part. The signal processing part generates the data voltage of an analog type based on the data signal DATA and the gamma reference voltage VGREF to output the data voltage to the buffer part. The buffer part compensates the data voltage to have a predetermined level, and then outputs the data voltage to the data line DL.

The data driving part 500 may be directly mounted on the display panel 100 or connected to the display panel 100 using a TCP. Alternatively, the data driving part 500 may be integrated on the display panel 100.

The display apparatus may further include a shutter glasses (not shown) including a left-eye shutter and right-eye shutter in synchronization with a period of a left-eye image and a right-eye image, respectively.

The display apparatus may further include a liquid crystal lens (not shown) formed on the display panel 100. The liquid crystal lens passes images displayed on the display panel 100 without a refraction of an image in the 2D image mode. The liquid crystal lens may transfer a first viewpoint image to a first viewpoint and transfer a second viewpoint image to a second viewpoint in the 3D image mode. For example, the first viewpoint image is a left-eye image, and the first viewpoint may correspond to a position of a left-eye of viewer. The second viewpoint image is a right-eye image, and the second viewpoint may correspond to a position of a right-eye of the viewer.

Alternatively, the display apparatus may further include a liquid crystal barrier (not shown) formed on the display panel 100. The liquid crystal barrier passes an image displayed on the display panel without a blocking in the 2D image mode. The liquid crystal barrier may selectively block an image displayed on the display panel to transfer a first viewpoint image to a first viewpoint and to transfer a second viewpoint image to a second viewpoint in the 3D image mode.

Figures 2, 3:
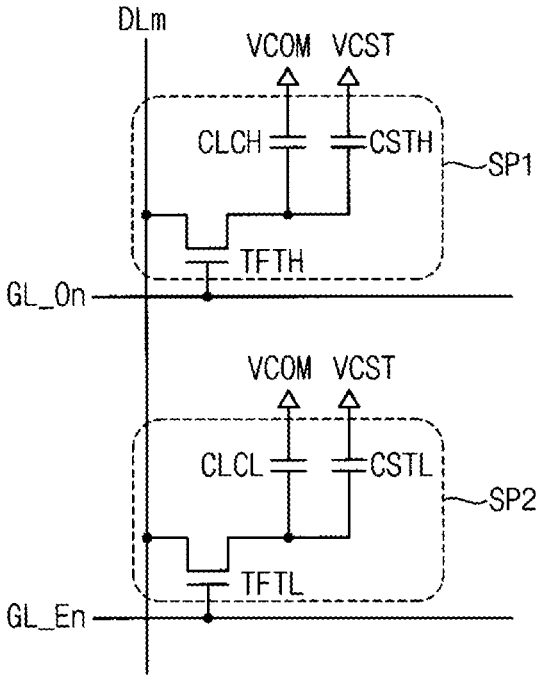
FIG. 2 is a circuit diagram showing a unit pixel of FIG. 1.
FIG. 3 is a concept diagram showing a look-up table referenced by a timing controller of FIG. 1.

FIG. 2 is a circuit diagram showing a unit pixel of FIG. 1.

Referring to FIG. 2, the unit pixel includes a first sub-pixel SP1 and a second sub-pixel SP2. The first sub-pixel may be a high pixel, and the second sib-pixel SP2 may be a low pixel.

In the 2D image mode, a first voltage is charged in the first sub-pixel SP1 within the unit pixel, and a second voltage different from the first voltage is charged in the second sub-pixel SP2 within the unit pixel. For example, the first voltage may be higher than the second voltage.

In the 3D image mode, a third voltage is charged in the first and the second sub-pixels SP1 and SP2 within the unit pixel at the same time.

The first sub-pixel SP1 includes a first switching element TFTH, a first liquid crystal capacitor CLCH and a first storage capacitor CSTH. The second sub-pixel SP2 includes a second switching element TFTL, a second liquid crystal capacitor CLCL and a second storage capacitor CSTL. The second sub-pixel SP2 may be disposed in adjacent to the first sub-pixel SP1 along an extending direction of the data line. The first sub-pixel SP1 and the second sub-pixel SP2 may share one data line.

The first switching element TFTH is connected to an n-th odd gate line GL_On and an m-th data line DLm. For example, in the first switching element TFTH, a gate electrode is connected to the n-th odd gate line GL_On, a source electrode is connected to the m-th data line DLm, and a drain electrode is connected to a first terminal of the first liquid crystal capacitor CLCH and a first terminal of the first storage capacitor CSTH. The first terminal of the first liquid crystal capacitor CLCH and the first terminal of the first storage capacitor CSTH may correspond to a first pixel electrode. A common voltage VCOM is applied to a second terminal of the first liquid crystal capacitor CLCH. A storage voltage VCST is applied to a second terminal of the first storage capacitor CSTH. For example, a value of the common voltage VCOM may be substantially equal to that of the storage voltage VCST.

The second switching element TFTL is connected to an n-th even gate line GL_En and an m-th data line DLm. In this case, the n-th even gate line GL_En may adjacent to the n-th odd gate line GL_On. For example, in the second switching element TFTL, a gate electrode is connected to the n-th even gate line GL_En, a source electrode is connected to the m-th data line DLm, and a drain electrode is connected to a first terminal of the second liquid crystal capacitor CLCL and a first terminal of the second storage capacitor CSTL. The first terminal of the second liquid crystal capacitor CLCL and the first terminal of the second storage capacitor CSTL may correspond to a second pixel electrode. The common voltage VCOM is applied to a second terminal of the second liquid crystal capacitor CLCL. The storage voltage VCST is applied to a second terminal of the second storage capacitor CSTL. For example, a value of the common voltage VCOM may be substantially equal to that of the storage voltage VCST. In the present exemplary embodiment, at least one of the first and the second storage capacitors CSTH and CSTL may be omitted.

FIG. 3 is a concept diagram showing a look-up table referenced by a timing controller 200 of FIG. 1.

Referring to FIGS. 1 to 3, the timing controller 200 includes a driving mode determining part (not shown), a control signal generating part (not shown), a data correcting part (not shown) and a gradation data converting part (not shown). The elements of the timing controller 200 are separately described in logical terms for ease of understanding, whether or not they are separate physical hardware elements.

The driving mode determining part determines the driving mode, for example a 2D image mode or a 3D image mode. The driving mode determining part may determine the driving mode based on the driving mode signal inputted from an external device (not shown). The driving mode determining part may determine the driving mode based on the input image data RGB.

The control signal generating part generates the first gate driving control signal CONT1_O and the second gate driving control signal CONT1_E based on the input control signal CONT to output the first gate driving control signal CONT1_O and the second gate driving control signal CONT1_E to the first gate driving part 300 and the second gate driving part 310, respectively.

The control signal generating part generates the second control signal CONT2 based on the input control signal CONT to output the second control signal CONT2 to the data driving part 500. The control signal generating part generates the third control signal CONT3 based on the input control signal CONT to output the third control signal CONT3 to the gamma reference voltage generating part 400.

The data correcting part receives the input image data RGB from an external device (not shown). The data correcting part compensates the input image data RGB to generate the data signal DATA.

The data correcting part may include a color characteristics compensating part (not shown), a dynamic capacitance compensating part (not shown).

The color characteristics compensating part receives the input image data RGB to perform an adaptive color correction ("ACC") operation. The color characteristics compensating part may compensate the input image data RGB by using a gamma curve.

The dynamic capacitance compensating part may performed a dynamic capacitance compensation ("DCC") compensating a gradation data of a current frame data by using a previous frame data and a current frame data.

The gradation data converting part converts an input gradation data based on the driving mode. The gradation data converting part outputs the converted gradation data to the data driving part 500. The input gradation data may be a gradation data of the data signal DATA. The gradation data converting part may refer the look-up table of FIG. 3.

The look-up table shown in FIG. 3 has rows represents an input gradation data GRAY, a first gradation data GRAYH and a second gradation data GRAYL.

In the 2D image mode, the gradation data converting part refers to the look-up table to convert an input gradation data GRAY into a first gradation data GRAYH corresponding to the first sub-pixel SP1 and a second gradation data GRAYL corresponding to the second sub-pixel SP2. For example, when the driving mode is a 2D image mode and the input gradation data GRAY is 1, the gradation data converting part converts the first gradation data GRAYH corresponding to the first sub-pixel SP1 into GRAYH1 and converts the second gradation data GRAYL corresponding to the second sub-pixel SP2 into GRAYL1.

The gradation data converting part outputs the inverted first gradation data and the inverted second gradation data to the data driving part 500. The data driving part 500 charges a data voltage corresponding to the first gradation data to the first sub-pixel SP1 and charges a data voltage corresponding to the second gradation data to the second sub-pixel SP2 in the 2D image mode. As a result, the different voltages are charged in the first sub-pixel SP1 and the second sub-pixels SP2.

In the 3D image mode, the gradation data converting part does not convert an input gradation data GRAY. That is, in the 3D image mode, the gradation data converting part outputs an input gradation data GRAY to the data driving part 500. The data driving part 500 charges a data voltage corresponding to the input gradation data into the first sub-pixel SP1 and the second sub-pixel SP2 by using the gamma reference voltage generating part 400.

The timing controller 200 may further include a memory (not shown). The look-up table may be stored in the memory. For one example, the memory may be formed within the timing controller 200. For another example, the memory may be formed on an external area of the timing controller 200.

Figure 4:
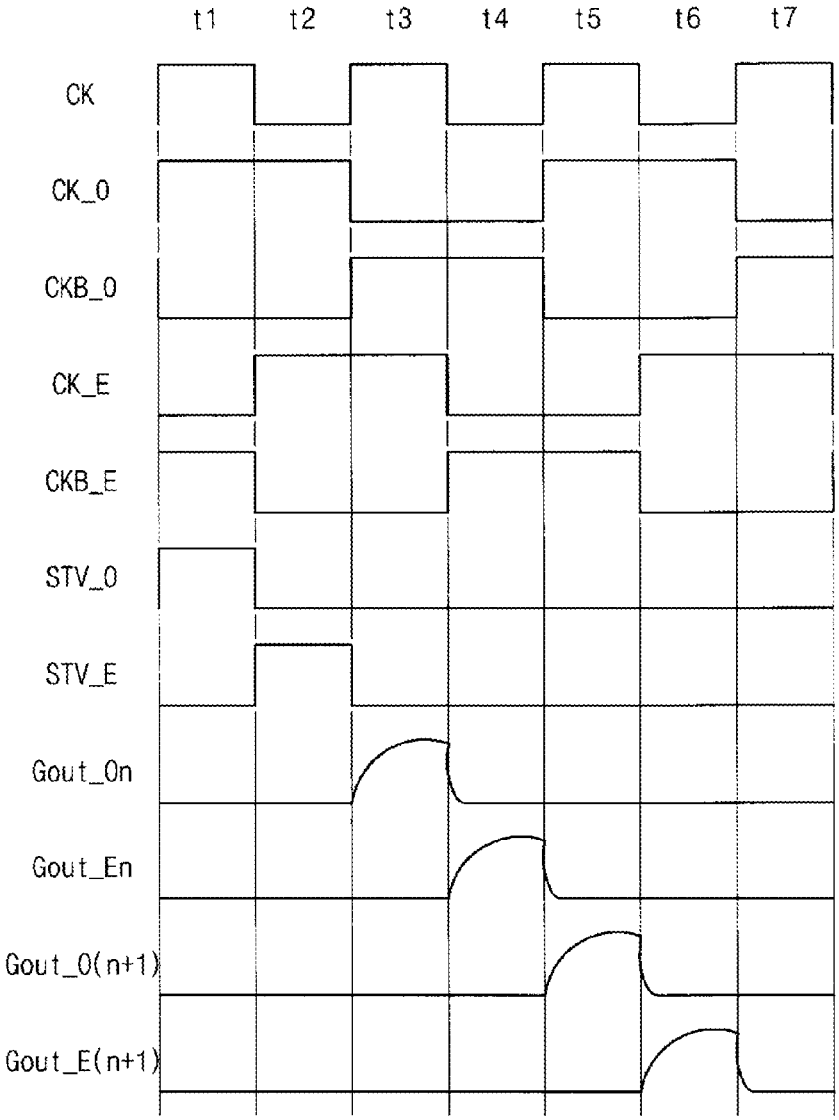
FIG. 4 is a waveform diagram explaining an operation of the display apparatus of FIG. 1 in a 2D image mode.

FIG. 4 is a waveform diagram explaining an operation of the display apparatus of FIG. 1 in a 2D image mode.

Hereinafter, an operation of a display apparatus according to an exemplary embodiment of the present invention at a 2D image mode is illustrated in detail.

Referring to FIGS. 1 to 4, in the display apparatus according to an exemplary embodiment of the present invention, a unit pixel of a display panel is divided into a high pixel and a low pixel to be driven in order to enhance a visibility in a 2D image mode. A driving frequency of the display apparatus of the present exemplary embodiment in a 2D image mode may be about 60 Hz.

The timing controller 200 receives an input control signal CONT from an external device (not shown). The input control signal CONT includes a driving mode signal including a 2D image mode and a 3D image mode. The input control signal CONT may further include a master clock signal CK, a data enable signal, a vertical synchronization signal and a horizontal synchronization signal. The timing controller 200 converts the input control signal CONT in accordance with the driving mode signal to generate the first gate driving control signal CONT1_O and the second gate driving control signal CONT1_E, and then outputs the first and the second driving control signals CONT1_O and CONT1_E to the first and the second gat driving part 300 and 310, respectively.

The first gate driving part 300 generates first gate signals Gout_On, Gout_O(n+1), . . . , etc., based on the first gate driving control signal CONT1_O to sequentially output the first gate signals Gout_On, Gout_O(n+1), . . . , etc., to odd-numbered gate line GL_O, wherein n is a natural number. The second gate driving part 310 generates second gate signals Gout_En, Gout_E(n+1), . . . , etc., based on the second gate driving control signal CONT1_E to sequentially output the second gate signals Gout_En, Gout_E(n+1), . . . , etc., to even-numbered gate line GL_E.

In a 2D image mode, the first gate driving part 300 and the second gate driving part 310 alternately output first and the second gate signals. For example, referring to FIG. 4, the first gate driving part 300 outputs a first gate signal Gout_On to an n-th odd gate line GL_On in a third interval t3, and the second gate driving part 310 outputs a second gate signal Gout_En to an n-th even gate line GL_En in a fourth interval t4 following the third interval t3. Then, the first gate driving part 300 outputs a first gate signal Gout_O(n+1) to an (n+1)-th odd gate line in a fifth interval t5, and the second gate driving part 310 outputs a second gate signal Gout_E(n+1) to an (n+1)-th gate line in a sixth interval t6 following the fifth interval t5. Thus, gate lines are sequentially scanned.

That is, the first gate driving part 300 drives the first sub-pixel SP1 of the unit pixel arranged in a matrix shape along a scanning direction, and the second gate driving part 310 drives the second sub-pixel SP2 of the unit pixel along the scanning direction. For example, a first voltage may be sequentially charged in the first sub-pixel SP1 along the scanning direction, and a second voltage smaller than the first voltage may be sequentially charged in the second sub-pixel SP2 along the scanning direction. Accordingly, the unit pixel is divided into a high pixel and a low pixel to be driven in a 2D image mode, thereby enhancing a visibility of the display.

For example, in the 2D image mode, a timing of the first gate driving control signal may be different from that of the second gate driving control signal. Particularly, the timing controller 200 generates a first odd clock signal CK_O and a second odd clock signal CKB_O based on a master clock signal CK, and then outputs the first and the second odd clock signals CK_O and CKB_O to the first gate driving part 300. In this case, the first odd clock signal CK_O has a high level in a first interval t1 and a second interval t2 and has a low level in a third interval t3 and a fourth interval t4. The second odd clock signal CKB_O has a substantially inverted phase with the first odd clock signal CK_O. Moreover, timing controller 200 generates a first even clock signal CK_E and a second even clock signal CKB_E based on the master clock signal CK, and then outputs the first and the second even clock signals CK_E and CKB_E to the second gate driving part 310. In this case, the first even clock signal CK_E has a high level in a second interval t2 and a third interval t3 and has a low level in a fourth interval t4 and a fifth interval t5. The second even clock signal CKB_E has a substantially inverted phase with the first even clock signal CK_E. That is, in a 2D image mode, interval periods of the first and the second odd clock signals CK_O and CKB_O and the first and the second even clock signals CK_E and CKB_E may be twice of an interval period of the master clock signal CK.

The timing controller 200 generates a first vertical start signal STV_O and a second vertical start signal STV_E based on the vertical start signal, and then outputs the first vertical start signal STV_O and the second vertical start signal STV_E to the first gate driving part 300 and the second gate driving part 310, respectively. For example, the timing controller 200 outputs the first vertical start signal STV_O to the first gate driving part 300 in a first interval t1, and outputs the second vertical start signal STV_E to the second gate driving part 310 in a second interval t2. Accordingly, the first and the second gate driving parts 300 and 310 alternately and sequentially output the first and the second gate signals to gate lines.

In a driving method of a display panel according to the present invention, the first and the second gate signals are outputted by using the first and the second odd clock signals CK_O and CKB_O and the first and the second even clock signals CK_E and CKB_E that are converted based on the master clock signal. However, the invention is not limited in any way to the examples discussed. Many variants and modifications are possible.

Hereinafter, an operation of a display apparatus according to an exemplary embodiment of the present invention at a 3D image mode is illustrated in detail.

Figure 5:
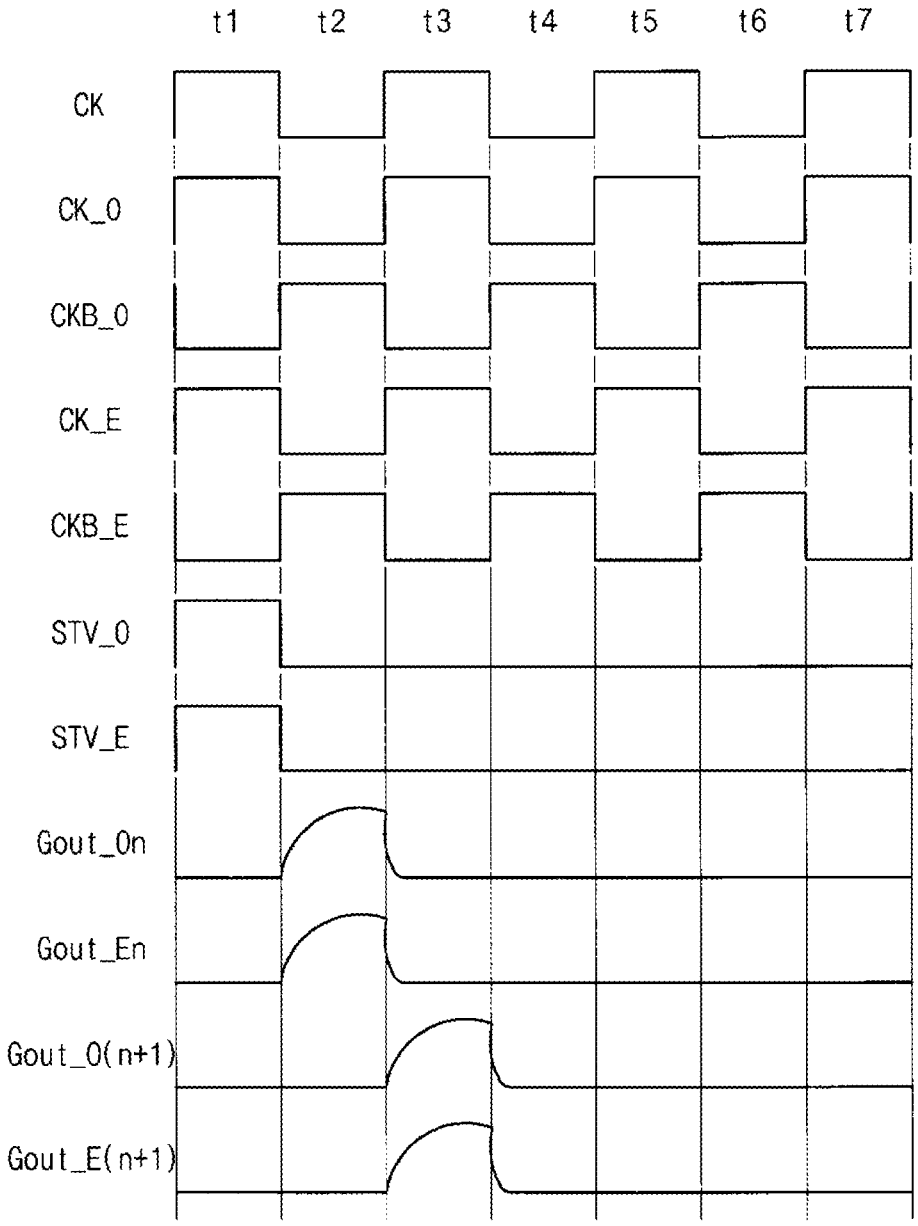
FIG. 5 is a waveform diagram explaining an operation of the display apparatus of FIG. 1 in a 3D image mode.

FIG. 5 is a waveform diagram explaining an operation of the display apparatus of FIG. 1 in a 3D image mode.

Referring to FIGS. 1, 2, 3 and 5, when the display apparatus according to one exemplary embodiment of the present invention is driven in a frequency of about 60 Hz at the 2D image mode, the display apparatus should be driven in a frequency of about 120 Hz at a 3D image mode because a left-eye image and a right-eye image are alternately displayed at a 3D image mode. That is, a fast driving speed is required at the 3D image mode. Thus, the display apparatus according to the present exemplary embodiment employs a method of driving that a high pixel and a low pixel are simultaneously driven at a 3D image mode.

When it is determined as a 3D image mode, the timing controller 200 generates the first gate driving control signal CONT1_O and the second gate driving control signal CONT1_E to output the first and the second gate driving control signals CONT1_O and CONT1_E to the first gate driving part 300 and the second gate driving part 310, respectively.

The first gate driving part 300 generates first gate signals Gout_On, Gout_O(n+1), . . . , etc., based on the first gate driving control signal CONT1_O to sequentially output the first gate signals Gout_On, Gout_O(n+1), . . . , etc., to an odd-numbered gate line GL_O. The second gate driving part 310 generates second gate signals Gout_En, Gout_E(n+1), . . . , etc., based on the second gate driving control signal CONT1_E to sequentially output the second gate signals Gout_En, Gout_E(n+1), . . . , etc., to an even-numbered gate line GL_E.

In a 3D image mode, the first gate driving part 300 and the second gate driving part 310 simultaneously output the first and the second gate signals, respectively. For example, referring to FIG. 5, the first gate driving part 300 outputs the first gate signal Gout_On to an n-th odd gate line GL_On during a second interval 't2', and the second gate driving part 310 outputs the second gate signal Gout_En to an n-th even gate line GL_En during the second interval 't2'. Then, the first gate driving part 300 outputs the first gate signal Gout_O(n+1) to an (n+1)-th odd gate line GL_O(n+1) during a third interval 't3', and the second gate driving part 310 outputs the second gate signal Gout_E(n+1) to an (n+1)-th even gate line GL_E (n+1) during the third interval 't3'. Thus, the gate lines are sequentially scanned.

That is, the first gate driving part 300 drives the first sub-pixel SP1 of the unit pixel arranged in a matrix shape along a scanning direction, and the second gate driving part 310 drives the second sub-pixel SP2 of the unit pixel along the scanning direction. For example, a third voltage is charged in the first and the second sub-pixels SP1 and SP2 at the same time. Thus, the time of scanning a gate line in a 3D image mode is twice longer than the time of scanning a gate line in a 2D image mode, thereby enhancing a display quality of the 3D image.

For example, in the 3D image mode, a timing of the first gate driving control signal may be substantially equal to that of the second gate driving control signal. Particularly, the timing controller 200 generates a first odd clock signal CK_O identical to the master clock signal CK and a second odd cock signal CKB_O having a substantially inverted phase with the first odd clock signal CK_O to output the first and the second odd clock signals CK_O and CKB_O to the first driving part 300. Moreover, timing controller 200 generates a first even clock signal CK_E identical to the master clock signal CK and a second even clock signal CKB_E having a substantially inverted phase that with the first even clock signal CK_E to output the first and the second even clock signals CK_E and CKB_E to the second gate driving part 310. That is, in a 3D image mode, interval periods of the first and the second odd clock signals CK_O and CKB_O and the first and the second even clock signals CK_E and CKB_E may be substantially equal to an interval period of the master clock signal CK.

The timing controller 200 generates a first vertical start signal STV_O and a second vertical start signal STV_E based on the vertical start signal to output the first vertical start signal STV_O and the second vertical start signal STV_E to the first gate driving part 300 and the second gate driving part 310, respectively. For example, during a first interval t1, the timing controller 200 outputs the first vertical start signal STV_O to the first gate driving part 300, and simultaneously outputs the second vertical start signal STV_E to the second gate driving part 310. Accordingly, the first gate driving part 300 sequentially outputs first gate signals to even numbered gate lines of the display panel, and simultaneously the second gate driving part 310 sequentially outputs second gate signals to odd numbered gate lines of the display panel. In the present exemplary embodiment, it is described that the first and the second vertical start signals are generated based on the vertical start signal. However, the invention is not limited in any way to the examples discussed. Many variants and modifications are possible. For example, the vertical start signal may be applied to the first and second gate driving parts, respectively. The first gate driving part 300 and the second gate driving part 310 may not be physically separated from each other and may be formed in a same driver IC.

Figure 6:
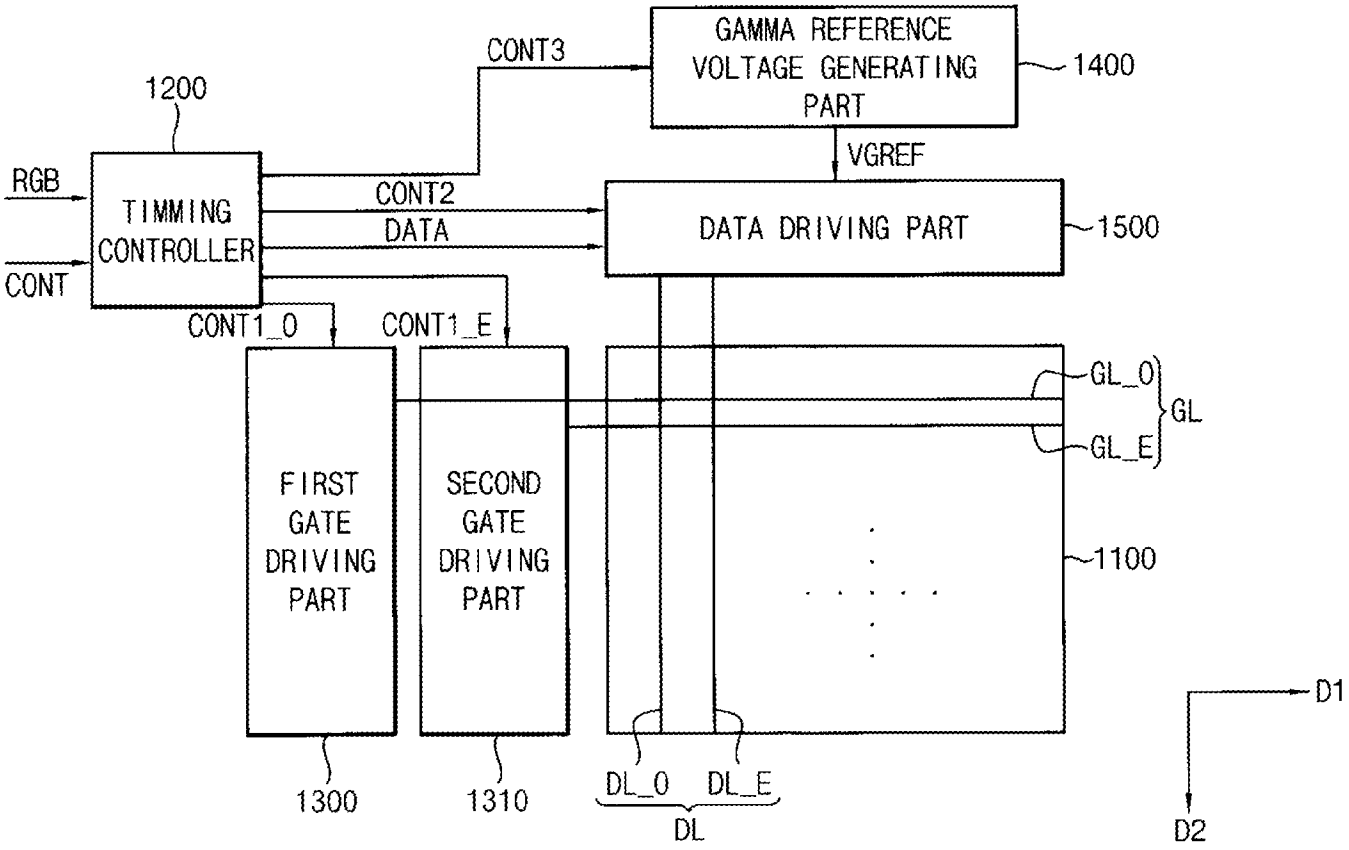
FIG. 6 is a block diagram illustrating a display apparatus according to another exemplary embodiment of the present invention.

FIG. 6 is a block diagram illustrating a display apparatus according to another exemplary embodiment of the present invention.

Referring to FIG. 6, a display apparatus includes a display panel 1100 and a panel driving part. The panel driving part includes a timing controller 1200, a first gate driving part 1300, a second gate driving part 1310, a gamma reference voltage generating part 1400 and a data driving part 1500.

The display panel 1100 includes a plurality of gate lines GL, a plurality of data lines DL and a plurality of unit pixels electrically connected to the gate line and the data line, respectively. The gate lines GL extend in a first direction D1, and the data lines DL extend in a second direction D2 crossing the first direction D1.

Each of the unit pixel may include a switching element (not shown), a liquid crystal capacitor (not shown) electrically connected to the switching element and a storage capacitor (not shown) electrically connected to the switching element. The unit pixels may be disposed in a matrix shape.

Each of the unit pixels includes a first sub-pixel and a second sub-pixel. A configuration of the unit pixel will be explained with reference to FIG. 7.

The timing controller 1200 receives input image data RGB and an input control signal CONT from an external device (not shown). The input image data may include a red image data R, a green image data G and a blue image data B. The input control signal CONT includes a driving mode signal including a 2D image mode and a 3D image mode. The input control signal CONT may further include a master clock signal and a data enable signal. The input control signal CONT may further include a vertical start signal and a horizontal start signal.

The timing controller 1200 generates a first gate driving control signal CONT1_O, a second gate driving control signal CONT1_E, a second control signal CONT2, a third control signal CONT3 and a data signal DATA based in the input image data RGB and the input control signal CONT.

The timing controller 1200 generates the first gate driving control signal CONT1_O for controlling an operation of the first gate driving part 1300 based on the input control signal CONT to output first gate driving control signal CONT1_O to the first gate driving part 1300. The first gate driving control signal CONT1_O may include the driving mode signal. The first gate driving control signal CONT1_O may include a first vertical start signal STV_O and a gate clock signal.

The timing controller 1200 generates the second gate driving control signal CONT1_E for controlling an operation of the second gate driving part 1310 based on the input control signal CONT to output second gate driving control signal CONT1_E to the second gate driving part 1310. The second gate driving control signal CONT1_E may include the driving mode signal. The second gate driving control signal CONT1_E may include a second vertical start signal STV_E and a gate clock signal.

The timing controller 1200 generates the second control signal CONT2 for controlling an operation of the data driving part 1500 based on the input control signal CONT to output second control signal CONT2 to the data driving part 1500. The second control signal CONT2 may include the driving mode signal. The second control signal CONT2 may include a horizontal start signal and a load signal.

The timing controller 1200 generates a data signal DATA by rendering the input image data RGB based on the driving mode to generate a data signal DATA. The timing controller 1200 output the data signal DATA to the data driving part 1500.

In the 2D image mode, the data signal DATA may include a 2D data signal. In the 3D image mode, the data signal DATA may include a left-eye data signal and a right-eye data. In the 3D image mode, the data signal DATA may further include a black data signal inserted between the left-eye data signal and the right-eye data signal.

The timing controller 1200 generates the third control signal CONT3 for controlling an operation of the gamma reference voltage generating part 1400 based on the input control signal CONT to output the third control signal CONT3 to the gamma reference voltage generating part 1400. The third control signal CONT3 may include a driving mode signal.

The timing controller 1200 may further include a control signal generating part (not shown) converting a frequency of the input control signal CONT inputted from an external device (not shown) or shifts a phase of the input control signal CONT.

The first gate driving part 1300 generates first gate signals for driving odd-numbered gate lines GL_O in response to the first gate driving control signal CONT1_O inputted from the timing controller 1200. The first gate driving part 1300 sequentially outputs the first gate signals to the odd-numbered gate lines GL_O. For example, the first gate driving part 1300 may generate the first gate signals outputted to the odd gate lines GL_O in accordance with a first odd clock signal CK_O of the first gate driving control signal CONT1_O, a second odd clock signal CKB_O having a timing different from the first odd clock signal CK_O and a first vertical start signal STV_O. For example, the second odd clock signal CKB_O may be an inverted signal of the first odd clock signal CK_O. A detailed driving method of the first gate driving part 1300 according to a driving mode will be described later.

The first gate driving part 1300 may be directly mounted on the display panel 1100 or connected to the display panel 1100 using a tape carrier package ("TCP"). Alternatively, the first gate driving part 1300 may be integrated on the display panel 1100.

The second gate driving part 1310 generates second gate signals for driving even-numbered gate lines GL_E in response to the second gate driving control signal CONT1_E inputted from the timing controller 1200. The second gate driving part 1310 sequentially outputs the second gate signals to the even-numbered gate lines GL_E. For example, the second gate driving part 1310 may generate the second gate signals outputted to the even-numbered gate lines GL_E in accordance with a first even clock signal CK_E of the second gate driving control signal CONT1_E, a second even clock signal CKB_E having a timing different from the first even clock signal CK_E and a second vertical start signal STV_E. For example, the second even clock signal CKB_E may be an inverted signal of the first even clock signal CK_E. A detailed driving method of the second gate driving part 1310 according to a driving mode will be described later.

The second gate driving part 1310 may be directly mounted on the display panel 1100 or connected to the display panel 1100 using a TCP. Alternatively, the second gate driving part 1310 may be integrated on the display panel 1100.

Thus, the first gate driving part 1300 and the second gate driving part 1310 may be independently driven.

The gamma reference voltage generating part 1400 generates a gamma reference voltage VGREF in response to the third control signal CONT3 inputted from the timing controller 1200. The gamma reference voltage generating part 1400 provides the gamma reference voltage VGREF to the data driving part 1500. The gamma reference voltage VGREF has values corresponding to each of the data signal DATA.

The gamma reference voltage generating part 1400 generates a gamma reference voltage VGREF different from each other with respect to same gradation data in accordance with the driving mode.

The gamma reference voltage generating part 1400 may be disposed within the timing controller 1200 or the data driving part 1500.

The data driving part 1500 receives the second control signal CONT2 and the data signal DATA from the timing controller 1200 and receives the gamma reference voltage VGREF from the gamma reference voltage generating part 1400. The data driving part 1500 converts the data signal DATA into a data voltage of an analog type by using the gamma reference voltage VGREF. The data driving part 1500 outputs the data voltage to the data line DL.

The data driving part 1500 may include a shift register (not shown), a latch (not shown), a signal processing part (not shown) and a buffer part (not shown). The shift register outputs a latch pulse to the latch. The latch temporarily stores the data signal DATA and then output the data signal DATA to the signal processing part. The signal processing part generates the data voltage of an analog type based on the data signal DATA and the gamma reference voltage VGREF to output the data voltage to the buffer part. The buffer part compensates the data voltage to have a predetermined level, and then outputs the data voltage to the data line DL.

The data driving part 1500 may be directly mounted on the display panel 1100 or connected to the display panel 1100 using a TCP. Alternatively, the data driving part 1500 may be integrated on the display panel 1100.

The display apparatus may further include a shutter glasses (not shown) including a left-eye shutter and right-eye shutter in synchronization with a period of a left-eye image and a right-eye image, respectively.

The display apparatus may further include a liquid crystal lens (not shown) formed on the display panel 1100. The liquid crystal lens passes images displayed on the display panel 1100 without a refraction of an image in the 2D image mode. The liquid crystal lens may transfer a first viewpoint image to a first viewpoint and transfer a second viewpoint image to a second viewpoint in the 3D image mode. For example, the first viewpoint image is a left-eye image, and the first viewpoint may correspond to a position of a left-eye of viewer. The second viewpoint image is a right-eye image, and the second viewpoint may correspond to a position of a right-eye of the viewer.

Alternatively, the display apparatus may further include a liquid crystal barrier (not shown) formed on the display panel 1100. The liquid crystal barrier passes an image displayed on the display panel without a blocking in the 2D image mode. The liquid crystal barrier may selectively block an image displayed on the display panel to transfer a first viewpoint image to a first viewpoint and to transfer a second viewpoint image to a second viewpoint in the 3D image mode.

Figure 7:
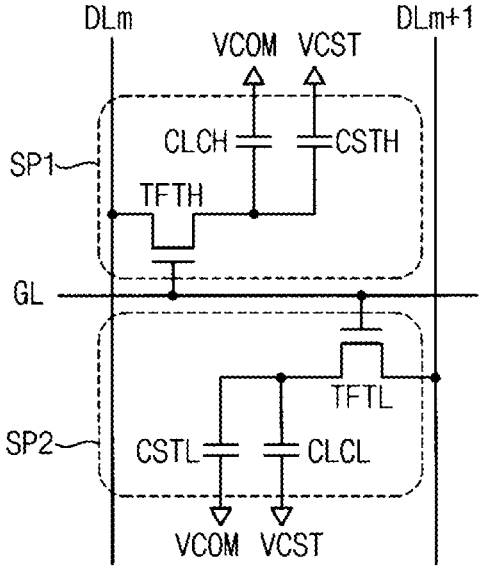
FIG. 7 is a circuit diagram showing a unit pixel of FIG. 6.

FIG. 7 is a circuit diagram showing a unit pixel of FIG. 6. For example, a unit pixel having a 1G2D (one gate line two data line) configuration is shown.

Referring to FIG. 7, the unit pixel includes a first sub-pixel SP1 and a second sub-pixel SP2. The first sub-pixel may be a high pixel, and the second sib-pixel SP2 may be a low pixel.

In the 2D image mode, a first voltage is charged in the first sub-pixel SP1 within the unit pixel, and a second voltage different from the first voltage is charged in the second sub-pixel SP2 within the unit pixel. For example, the first voltage may be greater than the second voltage.

In the 3D image mode, a third voltage is charged in the first and the second sub-pixels SP1 and SP2 within the unit pixel at the same time.

The first sub-pixel SP1 includes a first switching element TFTH, a first liquid crystal capacitor CLCH and a first storage capacitor CSTH. The second sub-pixel SP2 includes a second switching element TFTL, a second liquid crystal capacitor CLCL and a second storage capacitor CSTL. The second sub-pixel SP2 may be disposed in adjacent to the first sub-pixel SP1 along an extending direction of the data line. The first sub-pixel SP1 and the second sub-pixel SP2 may share one gate line.

The first switching element TFTH is connected to a gate line GL and an m-th data line DLm. For example, in the first switching element TFTH, a gate electrode is connected to the gate line GL, a source electrode is connected to the m-th data line DLm, and a drain electrode is connected to a first terminal of the first liquid crystal capacitor CLCH and a first terminal of the first storage capacitor CSTH. The first terminal of the first liquid crystal capacitor CLCH and the first terminal of the first storage capacitor CSTH may correspond to a first pixel electrode. A common voltage VCOM is applied to a second terminal of the first liquid crystal capacitor CLCH. A storage voltage VCST is applied to a second terminal of the first storage capacitor CSTH. For example, a value of the common voltage VCOM may be substantially equal to that of the storage voltage VCST.

The second switching element TFTL is connected to the gate line GL and an (m+1)-th data line DLm+1 adjacent to the m-th data line DLm. In the present exemplary embodiment, the m-th data line may be an odd numbered data line, and the (m+1)-th data line DLm may be an even-numbered data line. For example, in the second switching element TFTL, a gate electrode is connected to the gate line GL, a source electrode is connected to the (m+1)-th data line DLm+1, and a drain electrode is connected to a first terminal of the second liquid crystal capacitor CLCL and a first terminal of the second storage capacitor CSTL. The first terminal of the second liquid crystal capacitor CLCL and the first terminal of the second storage capacitor CSTL may correspond to a second pixel electrode. The common voltage VCOM is applied to a second terminal of the second liquid crystal capacitor CLCL. The storage voltage VCST is applied to a second terminal of the second storage capacitor CSTL. For example, a value of the common voltage VCOM may be substantially equal to that of the storage voltage VCST. In the present exemplary embodiment, at least one of the first and the second storage capacitors CSTH and CSTL may be omitted.

Hereinafter, an operation of a display apparatus according to an exemplary embodiment of the present invention at a 2D image mode is illustrated in detail.

Figure 8:
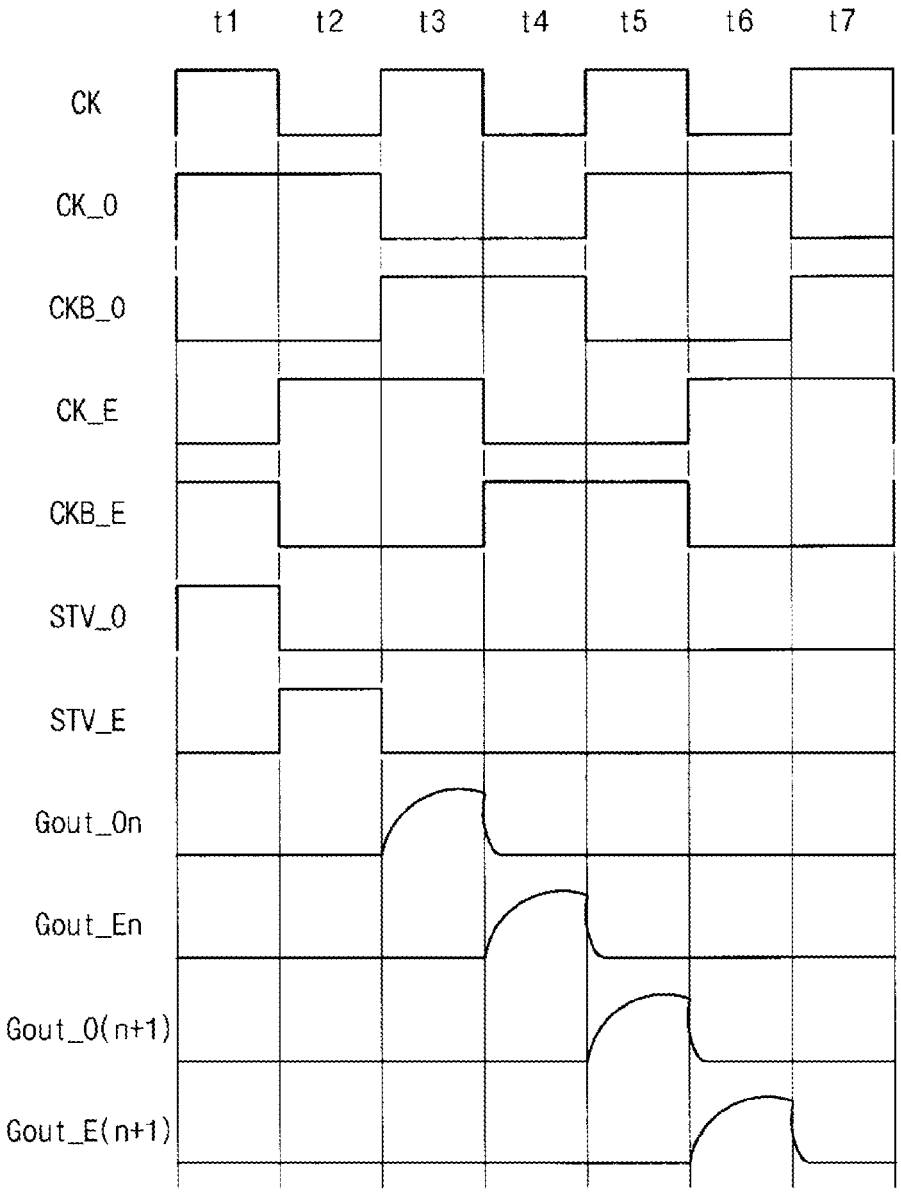
FIG. 8 is a waveform diagram explaining an operation of the display apparatus of FIG. 6 in a 2D image mode.

FIG. 8 is a waveform diagram explaining an operation of the display apparatus of FIG. 6 in a 2D image mode.

Referring to FIGS. 6 to 8, in the display apparatus according to an exemplary embodiment of the present invention, a unit pixel of a display panel is divided into a high pixel and a low pixel to be driven in order to enhance a visibility in a 2D image mode. A driving frequency of the display apparatus of the present exemplary embodiment in a 2D image mode may be about 60 Hz.

The timing controller 1200 receives an input control signal CONT from an external device (not shown). The input control signal CONT includes a driving mode signal including a 2D image mode and a 3D image mode. The input control signal CONT may further include a master clock signal CK, a data enable signal, a vertical synchronization signal and a horizontal synchronization signal. The timing controller 1200 converts the input control signal CONT in accordance with the driving mode signal to generate the first gate driving control signal CONT1_O and the second gate driving control signal CONT1_E, and then outputs the first and the second driving control signals CONT1_O and CONT1_E to the first and the second gat driving part 1300 and 1310, respectively.

The first gate driving part 1300 generates first gate signals Gout_On, Gout_O(n+1), . . . , etc., based on the first gate driving control signal CONT1_O to sequentially output the first gate signals Gout_On, Gout_O(n+1), . . . , etc., to odd-numbered gate line GL_O. The second gate driving part 1310 generates second gate signals Gout_En, Gout_E(n+1), . . . , etc., based on the second gate driving control signal CONT1_E to sequentially output the second gate signals Gout_En, Gout_E(n+1), . . . , etc., to even-numbered gate line GL_E.

In a 2D image mode, the first gate driving part 1300 and the second gate driving part 1310 alternately output first and the second gate signals. For example, referring to FIG. 8, the first gate driving part 1300 outputs a first gate signal Gout_On to an n-th odd gate line GL_On in a third interval t3, and the second gate driving part 1310 outputs a second gate signal Gout_En to an n-th even gate line GL_En in a fourth interval t4 following the third interval t3. In this case, n is a natural number. Then, the first gate driving part 1300 outputs a first gate signal Gout_O(n+1) to an (n+1)-th odd gate line in a fifth interval t5, and the second gate driving part 1310 outputs a second gate signal Gout_E(n+1) to an (n+1)-th gate line in a sixth interval t6 following the fifth interval t5. Thus, gate lines are sequentially scanned.

That is, the first gate driving part 1300 drives the first sub-pixel SP1 of the unit pixel arranged in a matrix shape along a scanning direction, and the second gate driving part 1310 drives the second sub-pixel SP2 of the unit pixel along the scanning direction. For example, a first voltage may be sequentially charged in the first sub-pixel SP1 along the scanning direction, and a second voltage smaller than the first voltage may be sequentially charged in the second sub-pixel SP2 along the scanning direction. Accordingly, the unit pixel is divided into a high pixel and a low pixel to be driven in a 2D image mode, thereby enhancing a visibility of the display.

For example, in the 2D image mode, a timing of the first gate driving control signal may be different from that of the second gate driving control signal. Particularly, the timing controller 1200 generates a first odd clock signal CK_O and a second odd clock signal CKB_O based on a master clock signal CK, and then outputs the first and the second odd clock signals CK_O and CKB_O to the first gate driving part 1300. In this case, the first odd clock signal CK_O has a high level in a first interval t1 and a second interval t2 and has a low level in a third interval t3 and a fourth interval t4. The second odd clock signal CKB_O has a substantially inverted phase with the first odd clock signal CK_O. Moreover, timing controller 1200 generates a first even clock signal CK_E and a second even clock signal CKB_E based on the master clock signal CK, and then outputs the first and the second even clock signals CK_E and CKB_E to the second gate driving part 1310. In this case, the first even clock signal CK_E has a high level in a second interval t2 and a third interval t3 and has a low level in a fourth interval t4 and a fifth interval t5. The second even clock signal CKB_E has a substantially inverted phase with the first even clock signal CK_E. That is, in a 2D image mode, interval periods of the first and the second odd clock signals CK_O and CKB_O and the first and the second even clock signals CK_E and CKB_E may be twice of an interval period of the master clock signal CK.

The timing controller 1200 generates a first vertical start signal STV_O and a second vertical start signal STV_E based on the vertical start signal, and then outputs the first vertical start signal STV_O and the second vertical start signal STV_E to the first gate driving part 1300 and the second gate driving part 1310, respectively. For example, the timing controller 1200 outputs the first vertical start signal STV_O to the first gate driving part 1300 in a first interval t1, and outputs the second vertical start signal STV_E to the second gate driving part 1310 in a second interval t2. Accordingly, the first and the second gate driving parts 1300 and 1310 alternately and sequentially output the first and the second gate signals to gate lines.

In a driving method of a display panel according to the present invention, the first and the second gate signals are outputted by using the first and the second odd clock signals CK_O and CKB_O and the first and the second even clock signals CK_E and CKB_E that are converted based on the master clock signal. However, the invention is not limited in any way to the examples discussed. Many variants and modifications are possible.

As described above, in a 2D image mode, an operation of the display apparatus according to another exemplary embodiment of the present invention is substantially equal to an operation of a display apparatus having a unit pixel of a conventional 1G2D configuration.

Hereinafter, an operation of a display apparatus according to another exemplary embodiment of the present invention at a 3D image mode is illustrated in detail.

Figure 9:
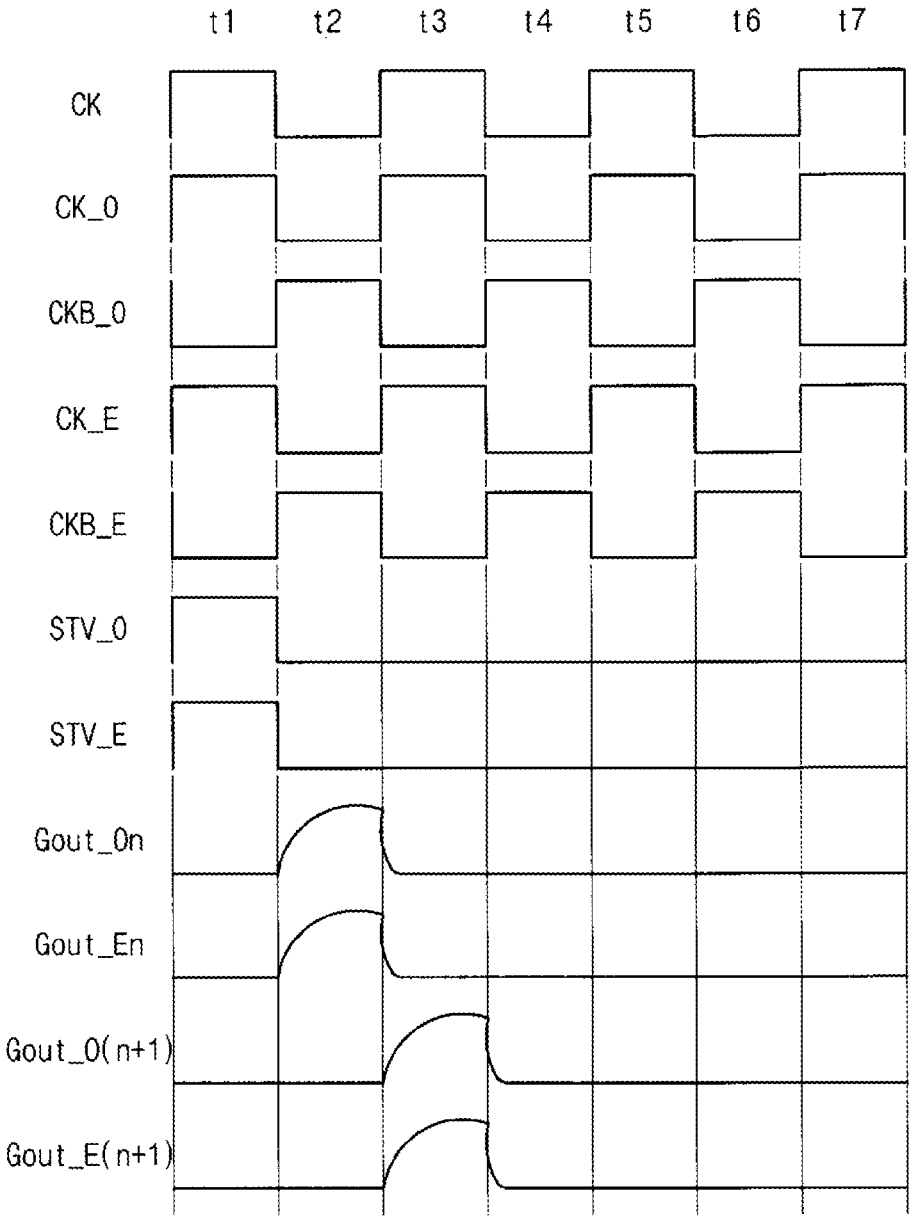
FIG. 9 is a waveform diagram explaining an operation of the display apparatus of FIG. 6 in a 3D image mode.

FIG. 9 is a waveform diagram explaining an operation of the display apparatus of FIG. 6 in a 3D image mode.

Referring to FIGS. 6, 7 and 9, when the display apparatus according to one exemplary embodiment of the present invention is driven in a frequency of about 60 Hz at the 2D image mode, the display apparatus should be driven in a frequency of about 120 Hz at a 3D image mode because a left-eye image and a right-eye image are alternately displayed at a 3D image mode. That is, a quick driving is required at the 3D image mode. Thus, the display apparatus according to the present exemplary embodiment employs a method of driving that a high pixel and a low pixel are simultaneously driven at a 3D image mode.

When it is determined as a 3D image mode, the timing controller 1200 generates the first gate driving control signal CONT1_O and the second gate driving control signal CONT1_E to output the first and the second gate driving control signals CONT1_O and CONT1_E to the first gate driving part 1300 and the second gate driving part 1310, respectively.

The first gate driving part 1300 generates first gate signals Gout_On, Gout_O(n+1), . . . , etc., based on the first gate driving control signal CONT1_O to sequentially output the first gate signals Gout_On, Gout_O(n+1), . . . , etc., to an odd-numbered gate line GL_O. The second gate driving part 1310 generates second gate signals Gout_En, Gout_E(n+1), . . . , etc., based on the second gate driving control signal CONT1_E to sequentially output the second gate signals Gout_En, Gout_E(n+1), . . . , etc., to an even-numbered gate line GL_E.

In a 3D image mode, the first gate driving part 1300 and the second gate driving part 1310 simultaneously output the first and the second gate signals, respectively. For example, referring to FIG. 5, the first gate driving part 1300 outputs the first gate signal Gout_On to an n-th odd gate line GL_On for a second interval 't2', and the second gate driving part 1310 outputs the second gate signal Gout_En to an n-th even gate line GL_En for the second interval 't2'. Then, the first gate driving part 1300 outputs the first gate signal Gout_O(n+1) to an (n+1)-th odd gate line GL_O(n+1) for a third interval 't3', and the second gate driving part 1310 outputs the second gate signal Gout_E(n+1) to an (n+1)-th even gate line GL_E(n+1) for the third interval 't3'. Thus, the gate lines are sequentially scanned.

That is, the first gate driving part 1300 drives the first sub-pixel SP1 of the unit pixel arranged in a matrix shape along a scanning direction, and the second gate driving part 1310 drives the second sub-pixel SP2 of the unit pixel along the scanning direction. For example, a third voltage is charged in the first and the second sub-pixels SP1 and SP2 in the same interval along the scanning direction. Thus, the time of scanning a gate line in a 3D image mode is twice longer than the time of scanning a gate line in a 2D image mode, thereby enhancing a display quality of the 3D image.

For example, in the 3D image mode, a timing of the first gate driving control signal may be substantially equal to that of the second gate driving control signal. Particularly, the timing controller 1200 generates a first odd clock signal CK_O identical to the master clock signal CK and a second odd cock signal CKB_O having a substantially inverted phase with the first odd clock signal CK_O to output the first and second odd clock signals CK_O and CKB_O to the first driving part 1300. Moreover, timing controller 1200 generates a first even clock signal CK_E identical to the master clock signal CK and a second even clock signal CKB_E having a substantially inverted phase that with the first even clock signal CK_E to output the first and second even clock signals CK_E and CKB_E to the second gate driving part 1310. That is, in a 3D image mode, interval periods of the first and the second odd clock signals CK_O and CKB_O and the first and the second even clock signals CK_E and CKB_E may be substantially equal to an interval period of the master clock signal CK.

The timing controller 1200 generates a first vertical start signal STV_O and a second vertical start signal STV_E based on the vertical start signal to output the first vertical start signal STV_O and the second vertical start signal STV_E to the first gate driving part 1300 and the second gate driving part 1310, respectively. For example, during a first interval t1, the timing controller 1200 outputs the first vertical start signal STV_O to the first gate driving part 1300, and simultaneously outputs the second vertical start signal STV_E to the second gate driving part 1310. Accordingly, the first gate driving part 1300 sequentially outputs first gate signals to even-numbered gate lines of the display panel, and simultaneously the second gate driving part 1310 sequentially outputs second gate signals to odd-numbered gate lines of the display panel. In the present exemplary embodiment, it is described that the first and the second vertical start signals are generated based on the vertical start signal. However, the invention is not limited in any way to the examples discussed. Many variants and modifications are possible. For example, the vertical start signal may be applied to the first and the second gate driving parts 1300 and 13010, respectively.

As described above, according to a 3D image mode of a display apparatus according to another exemplary embodiment of the present invention, gate lines are activated in the same timing, so that two gate electrodes adjacent to each other are turned on at the same timing. A time required for scanning the gate lines is reduced in a half in comparison with that of a display apparatus having a unit pixel of a conventional 1G2D configuration. Thus, a frame corresponding to a left-eye image and a frame corresponding to a right-eye are respectively displayed thereon, thereby realizing a 3D image.

Figure 10:
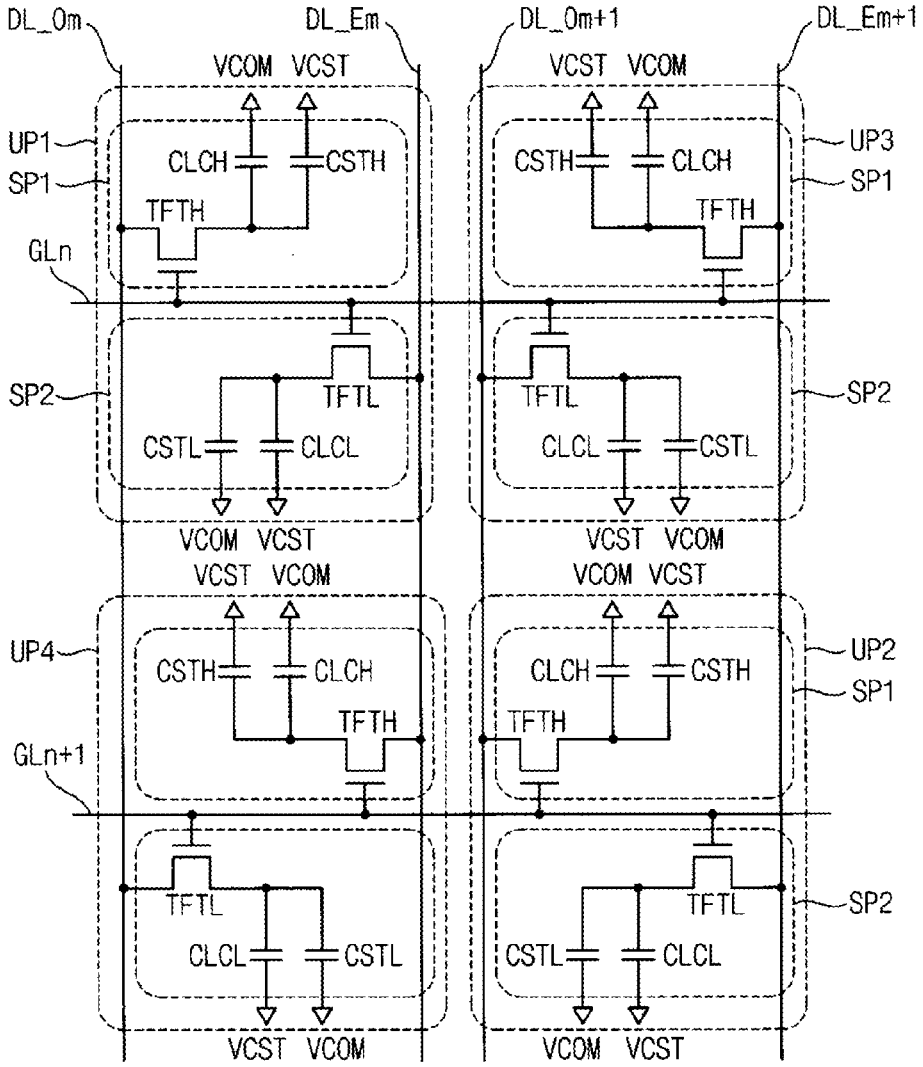
FIG. 10 is a circuit diagram showing a unit pixel of a staggered 1G2D (one gate line two data line) configuration.

FIG. 10 is a circuit diagram showing a unit pixel of a staggered 1G2D configuration.

Referring to FIG. 10, a connection configuration of a first unit pixel UP1 corresponding to an odd-numbered row of an odd-numbered column is substantially equal to a connection configuration of a second unit pixel UP2 corresponding to an even-numbered row of an even-numbered column. Moreover, a connection configuration of a third unit pixel UP3 corresponding to an odd-numbered row of an even-numbered column is substantially equal to a connection configuration of a fourth unit pixel UP4 corresponding to an even-numbered row of an odd-numbered column. Thus, the first to fourth unit pixels UP1, UP2, UP3 and UP4 are disposed in a staggered configuration.

For example, a first sub-pixel SP1 of the first unit pixel UP1 is connected to an odd-numbered gate line and an odd-numbered data line, and a second sub-pixel SP2 of the first unit pixel UP1 is connected to an odd-numbered gate line and an even-numbered data line. Hereinafter, in the present exemplary embodiment, an odd-numbered gate line is referred to as a reference numeral GLn, and an odd-numbered data line is referred to as reference numerals DL_Om and DL_Om+1. Moreover, an even-numbered gate line is referred to as a reference numeral GLn+1, and an even-numbered data line is referred to as reference numerals DL_Em and DLEm+1.

A first sub-pixel SP1 of the second unit pixel UP2 is connected to an even-numbered gate line and an odd-numbered data line, and a second sub-pixel SP2 of the second unit pixel UP2 is connected to an even-numbered gate line and an even-numbered data line.

A first sub-pixel SP1 of the third unit pixel UP3 is connected to an odd-numbered gate line and an even-numbered data line, and a second sub-pixel SP2 of the third unit pixel UP3 is connected to an odd-numbered gate line and an odd-numbered data line.

A first sub-pixel SP1 of the fourth unit pixel UP4 is connected to an even-numbered gate line and an even-numbered data line, and a second sub-pixel SP2 of the fourth unit pixel UP4 is connected to an even-numbered gate line and an odd-numbered data line.

Figure 11:
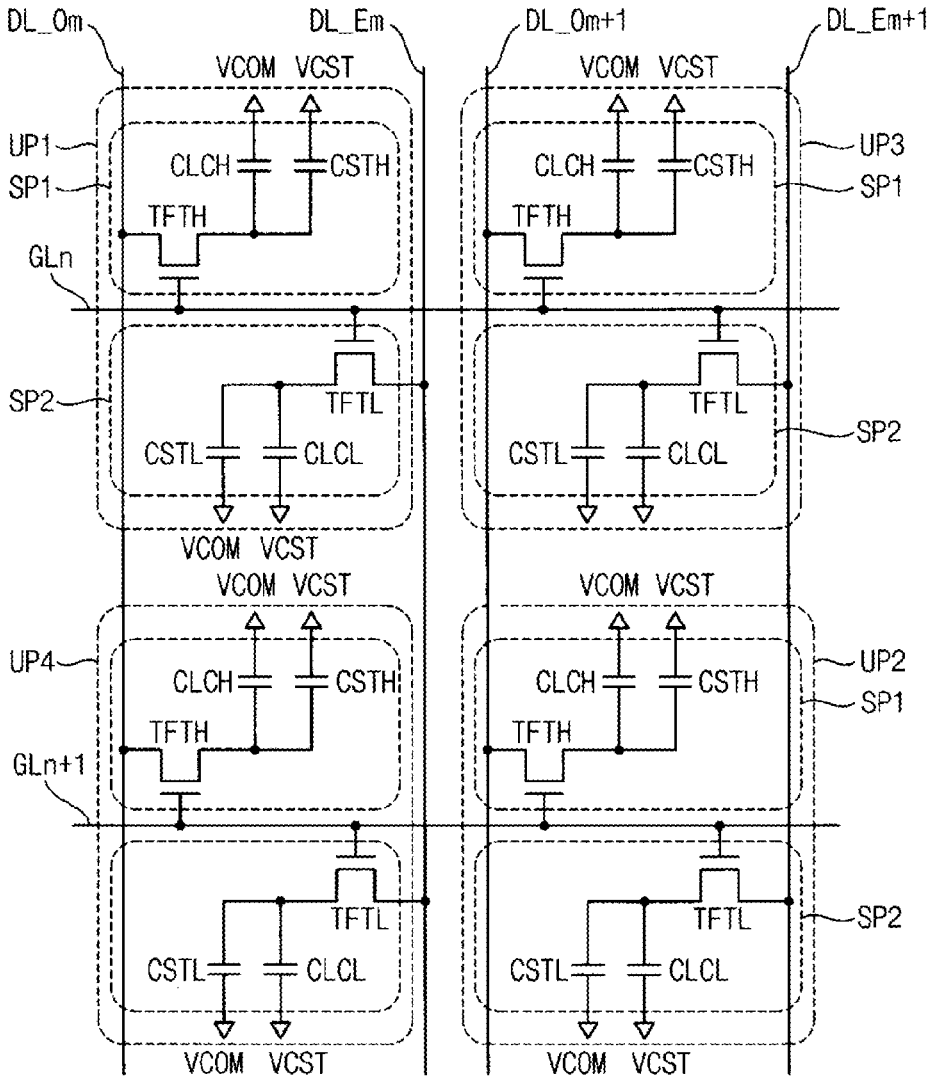
FIG. 11 is a circuit diagram showing a unit pixel of a non-staggered 1G2D configuration.

FIG. 11 is a circuit diagram showing a unit pixel of a non-staggered 1G2D configuration.

Referring to FIG. 11, a connection configuration of a first unit pixel UP1 corresponding to an odd-numbered row of an odd-numbered column is substantially equal to a connection configuration of a second unit pixel UP2 corresponding to an even-numbered row of an even-numbered column. Moreover, a connection configuration of a third unit pixel UP3 corresponding to an odd-numbered row of an even-numbered column is substantially equal to a connection configuration of a fourth unit pixel UP4 corresponding to an even-numbered row of an odd-numbered column. Moreover, a connection configuration of the first unit pixel UP1 corresponding to an odd-numbered row of an even-numbered column is substantially equal to a connection configuration of the fourth unit pixel UP4 corresponding to an even-numbered row of an odd-numbered column. Thus, the first to fourth unit pixels UP1, UP2, UP3 and UP4 are substantially equal to each other.

For example, a first sub-pixel SP1 of the first unit pixel UP1 is connected to an odd-numbered gate line and an odd-numbered data line, and a second sub-pixel SP2 of the first unit pixel UP1 is connected to an odd-numbered gate line and an even-numbered data line. Hereinafter, in the present exemplary embodiment, an odd-numbered gate line is referred to as a reference numeral GLn, and an odd-numbered data line is referred to as reference numerals DL_Om and DL_Om+1. Moreover, an even-numbered gate line is referred to as a reference numeral GLn+1, and an even-numbered data line is referred to as reference numerals DL_Em and DLEm+1.

A first sub-pixel SP1 of the second unit pixel UP2 is connected to an even-numbered gate line and an odd-numbered data line, and a second sub-pixel SP2 of the second unit pixel UP2 is connected to an even-numbered gate line and an even-numbered data line.

A first sub-pixel SP1 of the third unit pixel UP3 is connected to an odd-numbered gate line and an odd-numbered data line, and a second sub-pixel SP2 of the third unit pixel UP3 is connected to an odd-numbered gate line and an even-numbered data line.

A first sub-pixel SP1 of the fourth unit pixel UP4 is connected to an even-numbered gate line and an odd-numbered data line, and a second sub-pixel SP2 of the fourth unit pixel UP4 is connected to an even-numbered gate line and an even-numbered data line.

A size of a first sub-pixel SP1 and a second sub-pixel SP2 are substantially equal to each other or different from each other, which are disposed in each of the unit pixels UP1, UP2, UP3 and UP4 having a non-staggered 1G2D configuration. In the present exemplary embodiment, a size of the sub-pixels may correspond with a size of a pixel electrode electrically connected to a transistor.

When driving consecutive gate lines at the same time, difference in brightness can be recognized by the viewer. However, the recognition of the difference in brightness may be prevented by adjusting a manner activating gate lines.

That is, during one frame, an n-th gate line and an (n+1)-th gate line are scanned at the same time. For example, first gate line and second gate line are simultaneously scanned, third gate line and fourth gate line are simultaneously scanned, and then fifth gate line and sixth gate line are simultaneously scanned.

During a consecutive frame, (n−1)-th gate line and an n-th gate line are scanned at the same time. For example, first gate line is scanned, second gate line and third gate line are simultaneously scanned, and then fourth gate line and fifth gate line are simultaneously scanned.

Thus, the recognition of the difference in brightness may be prevented by adjusting a manner activating gate lines.

As described above, according to the present exemplary embodiment, two gate lines adjacent to each other, for example, an n-th gate line and an (n+1)-th gate line are coupled to each other to be sequentially scanned during a first frame and two gate lines adjacent to each other, for example, an (n−1)-th gate line and an n-th gate line are coupled to each other to be sequentially scanned in a second frame, so that it may prevent a luminance difference from being viewed by adjusting a manner activating gate lines.

According to a method of driving a display panel and a display apparatus for performing the method, a unit pixel is divided into a high pixel and a low pixel to be driven when a 2D image is displayed thereon, thereby enhancing a visibility. Moreover, the high pixel and the low pixel are driven at the same time to increase a scanning time of a gate line when a 3D image is displayed thereon, thereby enhancing a display characteristics of the 3D image. Thus, a display quality may be enhanced when the display panel displays the 2D image and the 3D image.

The foregoing is illustrative of the present invention and is not to be construed as limiting thereof. Although a few exemplary embodiments of the present invention have been described, those skilled in the art will readily appreciate that many modifications are possible in the exemplary embodiments without materially departing from the novel teachings and advantages of the present invention. Accordingly, all such modifications are intended to be included within the scope of the present invention as defined in the claims. In the claims, means-plus-function clauses are intended to cover the structures described herein as performing the recited function and not only structural equivalents but also equivalent structures. Therefore, it is to be understood that the foregoing is illustrative of the present invention and is not to be construed as limited to the specific exemplary embodiments disclosed, and that modifications to the disclosed exemplary embodiments, as well as other exemplary embodiments, are intended to be included within the scope of the appended claims. The present invention is defined by the following claims, with equivalents of the claims to be included therein.

What is claimed is:

1. A method of driving a display panel, comprising:

determining whether a driving mode is a two-dimensional image mode or a three-dimensional image mode;

generating a first gate driving control signal and a second gate driving control signal by converting an input control signal inputted in accordance with the driving mode;

outputting a first gate signal to an odd-numbered gate line connected to a first sub-pixel within a unit pixel of the display panel based on the first gate driving control signal; and outputting a second gate signal to an even-numbered gate line connected to a second sub-pixel within the unit pixel of the display panel based on the second gate driving control signal, wherein the odd-numbered gate line and the even numbered gate line adjacent to the odd-numbered gate line have a different activation time in a two-dimensional image mode and the odd-numbered gate line and the even numbered gate line adjacent to the odd-numbered gate line have a same activation time in a three-dimensional image mode irrespective of a frame frequency, and wherein a frame of the three-dimensional image mode is shorter than a frame of the two-dimensional image mode, the frame being time of scanning all gate lines.

2. The method of claim 1, wherein the first sub-pixel is a high pixel and the second sub-pixel is a low pixel having a lower pixel voltage than the high pixel.

3. The method of claim 2, wherein a first odd-numbered gate line and a first even numbered gate line adjacent to the first odd-numbered gate line have a first activation time, and a second odd-numbered gate line adjacent to the first even-numbered gate line and a second even numbered gate line adjacent to the second odd-numbered gate line have a second activation time having one interval delay in the three-dimensional image mode.

4. The method of claim 3, further comprising supplying the first gate driving control signal and the second driving control signal to a first gate driving part and a second gate driving part, respectively.

5. The method of claim 2, further comprising supplying the first gate driving control signal and the second driving control signal to a first gate driving part and a second gate driving part, respectively.

6. The method of claim 1, wherein a first odd-numbered gate line and a first even numbered gate line adjacent to the first odd-numbered gate line have a first activation time, and a second odd-numbered gate line adjacent to the first even-numbered gate line and a second even numbered gate line adjacent to the second odd-numbered gate line have a second activation time having one interval delay in the three-dimensional image mode.

7. The method of claim 6, further comprising supplying the first gate driving control signal and the second driving control signal to a first gate driving part and a second gate driving part, respectively.

8. The method of claim 1, further comprising supplying the first gate driving control signal and the second driving control signal to a first gate driving part and a second gate driving part, respectively.

9. A method of driving a display panel, comprising:

determining whether a driving mode is a two-dimensional image mode or a three-dimensional image mode;

generating a first gate driving control signal and a second gate driving control signal by converting an input control signal inputted in accordance with the driving mode;

outputting a first gate signal to an odd-numbered gate line connected to a first sub-pixel and a second sub-pixel based on the first gate driving control signal; and outputting a second gate signal to an even-numbered gate line connected to a first sub-pixel and a second sub-pixel based on the second gate driving control signal, wherein the odd-numbered gate line and the even numbered gate line adjacent to the odd-numbered gate line have a different activation time in a two-dimensional image mode, and the odd-numbered gate line and the even numbered gate line adjacent to the odd-numbered gate line have a same activation time in a three-dimensional image mode irrespective of a frame frequency, and wherein a frame of the three-dimensional image mode is shorter than a frame of the two-dimensional image mode, the frame being time of scanning all gate lines.

10. The method of claim 9, wherein the first sub-pixel is a high pixel and the second sub-pixel is a low pixel having a lower pixel voltage than the high pixel.

11. The method of claim 10, wherein a first odd-numbered gate line and a first even numbered gate line adjacent to the first odd-numbered gate line have a first activation time, and a second odd-numbered gate line adjacent to the first even-numbered gate line and a second even numbered gate line adjacent to the second odd-numbered gate line have a second activation time having one interval delay in the three-dimensional image mode.

12. The method of claim 11, further comprising supplying the first gate driving control signal and the second driving control signal to a first gate driving part and a second gate driving part, respectively.

13. The method of claim 10, further comprising supplying the first gate driving control signal and the second driving control signal to a first gate driving part and a second gate driving part, respectively.

14. The method of claim 9, wherein a first odd-numbered gate line and a first even numbered gate line adjacent to the first odd-numbered gate line have a first activation time, and a second odd-numbered gate line adjacent to the first even-numbered gate line and a second even numbered gate line adjacent to the second odd-numbered gate line have a second activation time having one interval delay in the three-dimensional image mode.

15. The method of claim 14, further comprising supplying the first gate driving control signal and the second driving control signal to a first gate driving part and a second gate driving part, respectively.

16. The method of claim 9, further comprising supplying the first gate driving control signal and the second driving control signal to a first gate driving part and a second gate driving part, respectively.

17. A display apparatus comprising:

a display panel comprising a plurality of unit pixels comprising a first sub-pixel and a second sub-pixel;

a timing controller determining whether a driving mode is a two-dimensional image mode or a three-dimensional image mode, and generating a first gate driving control signal and a second gate driving control signal by converting an input control signal inputted in accordance with the driving mode;

a first gate driving part outputting a first gate signal to an odd-numbered gate line; and a second gate driving part outputting a second gate signal to an even-numbered gate line, wherein the first gate signal and the second gate signal have a different activation time in a two-dimensional image mode and the first gate signal and the second gate signal adjacent to the first gate signal have a same activation time in a three-dimensional image mode irrespective of a frame frequency, and wherein a frame of the three-dimensional image mode is shorter than a frame of the two-dimensional image mode, the frame being time of scanning all gate lines.

18. The display apparatus of claim 17, wherein an N-th even gate line is disposed between an n-th odd gate line and an (n+1)-th odd gate line ('n' is a natural number), and the first gate signal or the second gate signal is sequentially outputted to the n-th odd gate line, the n-th even gate line and the (n+1)-th odd gate line in the two-dimensional image mode.

19. The display apparatus of claim 18, wherein a first voltage is charged in the first sub-pixel, and a second voltage lower than the first voltage is charged in the second sub-pixel.

20. The display apparatus of claim 17, wherein an n-th even gate line is disposed between an n-th odd gate line and an (n+1)-th odd gate line ('n' is a natural number) in the 2D image mode, and the first gate signal or the second gate signal is simultaneously outputted to the n-th even gate line and the N-th odd gate line in the three-dimensional image mode.

21. The display apparatus of claim 20, wherein a third voltage is charged in the first and the second sub-pixels.

22. The display apparatus of claim 17, wherein each of the first sub-pixel and the second sub-pixel in the unit pixels in a same column is connected to different gate lines and a same data line.

23. The display apparatus of claim 22, wherein the first sub-pixel comprises a first switching element, a first liquid crystal capacitor connected to the first switching element and a first storage capacitor connected to the first switching element, the second sub-pixel comprises a second switching element, a second liquid crystal capacitor connected to the second switching element and a first storage capacitor connected to the second switching element, the first switching element is connected to an odd-numbered gate line, and the second switching element is connected to an even-numbered gate line.

24. The display apparatus of claim 17, wherein each of the first sub-pixel and the second sub-pixel in the unit pixels in a same row is connected to a same gate line and the different data lines.

25. The display apparatus of claim 24, wherein each of the unit pixels comprises:

a first unit pixel connected to a first gate line, a first data line and a second data line adjacent to the first data line;

a second unit pixel connected to a second gate line adjacent to the first gate line, a third data line adjacent to the second data line and a fourth data line adjacent to the third data line;

a third unit pixel connected to the first gate line, the third data line and the fourth data line; and a fourth unit pixel connected to the second gate line, the first data line and the second data line, and wherein a switching element of the first sub-pixel of the first unit pixel is connected to the first gate line and the first data line, and a switching element of the first sub-pixel of the third unit pixel is connected to the first gate line and the fourth data line.

26. The display apparatus of claim 25, wherein a switching element of the second sub-pixel of the first unit pixel is connected to the first gate line and the second data line, and a switching element of the second sub-pixel of the third unit pixel is connected to the first gate line and the third data line.

27. The display apparatus of claim 25, wherein a switching element of the first sub-pixel of the second unit pixel is connected to the second gate line and the third data line, and a switching element of the first sub-pixel of the fourth unit pixel is connected to the second gate line and the second data line.

28. The display apparatus of claim 25, wherein a switching element of the second sub-pixel of the second unit pixel is connected to the second gate line and the fourth data line, and a switching element of the second sub-pixel of the fourth unit pixel is connected to the second gate line and the first data line.

29. The display apparatus of claim 24, wherein each of the unit pixels comprises:

a first unit pixel connected to a first gate line, a first data line and a second data line adjacent to the first data line;

a second unit pixel connected to a second gate line adjacent to the first gate line, a third data line adjacent to the second data line and a fourth data line adjacent to the third data line;

a third unit pixel connected to the first gate line, the third data line and the fourth data line; and a fourth unit pixel connected to the second gate line, the first data line and the second data line, and wherein a switching element of the first sub-pixel of the first unit pixel is connected to the first gate line and the first data line, and a switching element of the first sub-pixel of the third unit pixel is connected to the first gate line and the third data line.

30. The display apparatus of claim 29, wherein a switching element of the second sub-pixel of the first unit pixel is connected to the first gate line and the second data line, and a switching element of the second sub-pixel of the third unit pixel is connected to the first gate line and the fourth data line.

31. The display apparatus of claim 29, wherein a switching element of the first sub-pixel of the second unit pixel is connected to the second gate line and the third data line, and a switching element of the first sub-pixel of the fourth unit pixel is connected to the second gate line and the first data line.

32. The display apparatus of claim 31, wherein a switching element of the second sub-pixel of the second unit pixel is connected to the second gate line and the fourth data line, and a switching element of the second sub-pixel of the fourth unit pixel is connected to the second gate line and the second data line.

* * * * *